US012643719B2

(12) United States Patent
Miller et al.

(10) Patent No.: US 12,643,719 B2
(45) Date of Patent: Jun. 2, 2026

(54) CONTAINER WITH HANDLE AND LATCHING SYSTEM

(71) Applicant: YETI Coolers, LLC, Austin, TX (US)

(72) Inventors: Mark D. Miller, San Marcos, TX (US); Nicholas James Lombardi, Austin, TX (US); Steven M. Scott, Austin, TX (US); Elizabeth Ruchte, Austin, TX (US); Andrew J. Winterhalter, Austin, TX (US); Liza Morris, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 18/411,881

(22) Filed: Jan. 12, 2024

(65) Prior Publication Data

US 2024/0140664 A1 May 2, 2024

Related U.S. Application Data

(62) Division of application No. 17/835,849, filed on Jun. 8, 2022, now Pat. No. 11,912,477.

(51) Int. Cl.
*B65D 51/24* (2006.01)
*B65D 25/04* (2006.01)
(Continued)

(52) U.S. Cl.
CPC ..... *B65D 51/242* (2013.01); *B65D 25/04* (2013.01); *B65D 43/167* (2013.01); *B65D 43/22* (2013.01)

(58) Field of Classification Search
CPC ..... B65D 51/24; B65D 51/242; B65D 25/04; B65D 43/167; B65D 43/22; A45C 5/04; A45C 13/26
See application file for complete search history.

(56) References Cited

U.S. PATENT DOCUMENTS 2,673,630 A 3/1954 Axtell
2,795,946 A * 6/1957 Check ..... E05C 19/14 70/76
(Continued)

FOREIGN PATENT DOCUMENTS

CA 136000 S 6/2011
CA 138404 S 7/2011
(Continued)

OTHER PUBLICATIONS

Feb. 4, 2025—(NZ) First Examination Report—App. No. 816681.
(Continued)

*Primary Examiner* — Shawn M Braden
(74) *Attorney, Agent, or Firm* — Banner & Witcoff, Ltd.

(57) ABSTRACT

A container having a base and a lid is provided. The lid may be rotatable about a hinge from a closed configuration to an open configuration and may be secured, via one or more latching assemblies. The latch assembly may comprise a latch body, a locking member, a biasing member, and an activating member. The lid may have a handle that has a stowed and a carry position, where the handle may be maintained in the stowed position until acted upon by a first force greater than a threshold force to move the handle from the stowed position to the carry position. Similarly, when in the carry position, the handle may be maintained in the carry position until acted upon by a second force greater than the threshold force to move the handle from the carry position to the stowed position.

17 Claims, 16 Drawing Sheets

(51) Int. Cl.
*B65D 43/16* (2006.01)
*B65D 43/22* (2006.01)

(56) References Cited

U.S. PATENT DOCUMENTS

| | | | |
|---|---|---|---|
| 3,556,623 | A | 1/1971 | Damijonaitis |
| 3,562,849 | A | 2/1971 | Brayshaw |
| 3,627,075 | A | 12/1971 | Enders et al. |
| 3,871,100 | A | 3/1975 | Hildebrandt |
| 4,034,684 | A | 7/1977 | Carson et al. |
| 4,061,305 | A | 12/1977 | Beekenkamp |
| 4,061,323 | A | 12/1977 | Beekenkamp |
| 4,069,849 | A | 1/1978 | O'Grady |
| 4,073,484 | A | 2/1978 | Beekenkamp |
| 4,133,412 | A | 1/1979 | Hildebrandt |
| 4,154,435 | A | 5/1979 | Alessio |
| 4,155,386 | A | 5/1979 | Alessio |
| 4,252,304 | A | 2/1981 | Pettican |
| 4,277,208 | A | 7/1981 | Jackson et al. |
| 4,278,243 | A | 7/1981 | Alessio |
| 4,298,095 | A | 11/1981 | Jackson et al. |
| 4,306,709 | A | 12/1981 | Hurn |
| 4,308,934 | A | 1/1982 | Jackson et al. |
| 4,310,150 | A | 1/1982 | Andrews |
| 4,314,782 | A | 2/1982 | Beekenkamp |
| 4,378,107 | A | 3/1983 | Wagster et al. |
| 4,412,676 | A | 11/1983 | Jackson |
| 4,420,678 | A | 12/1983 | Kalb |
| 4,442,779 | A | 4/1984 | Basten et al. |
| 4,450,961 | A | 5/1984 | Bies et al. |
| 4,483,524 | A | 11/1984 | Basten et al. |
| 4,535,897 | A | 8/1985 | Remington et al. |
| 4,544,050 | A | 10/1985 | Seynhaeve |
| 4,546,528 | A | 10/1985 | Langas |
| 4,591,301 | A | 5/1986 | Pelfrey |
| 4,619,364 | A | 10/1986 | Czopor, Jr. |
| 4,653,637 | A | 3/1987 | Wallace |
| 4,703,852 | A | 11/1987 | Verdier |
| 4,735,245 | A | 4/1988 | Cox |
| 4,826,049 | A | 5/1989 | Speer |
| 4,836,374 | A | 6/1989 | Hutchins et al. |
| 4,934,422 | A | 6/1990 | Hempy et al. |
| 5,011,013 | A | 4/1991 | Meisner et al. |
| 5,070,562 | A | 12/1991 | Lentino |
| D330,162 | S | 10/1992 | Verchere |
| 5,193,706 | A | 3/1993 | Hanna et al. |
| 5,307,974 | A | 5/1994 | Chitty et al. |
| 5,375,636 | A | 12/1994 | Bosten et al. |
| 5,383,977 | A | 1/1995 | Pearce |
| D358,933 | S | 6/1995 | Stein |
| 5,427,200 | A | 6/1995 | Yemini |
| 5,443,310 | A | 8/1995 | DeFelice et al. |
| D367,360 | S | 2/1996 | Wolff |
| 5,503,571 | A | 4/1996 | Cheslock |
| 5,538,102 | A | 7/1996 | Yemini |
| 5,542,639 | A | 8/1996 | Wixey et al. |
| 5,560,448 | A | 10/1996 | Yemini |
| 5,562,208 | A | 10/1996 | Hasler et al. |
| 5,579,947 | A | 12/1996 | Yemini |
| 5,595,228 | A | 1/1997 | Meisner et al. |
| 5,598,924 | A | 2/1997 | McCann |
| 5,603,559 | A | 2/1997 | Yemini |
| D378,874 | S | 4/1997 | Dickinson et al. |
| D379,266 | S | 5/1997 | Dickinson et al. |
| 5,637,420 | A | 6/1997 | Jones, Jr. et al. |
| 5,645,332 | A | 7/1997 | Snoke et al. |
| 5,662,223 | A | 9/1997 | Sylegård |
| D385,111 | S | 10/1997 | Dickinson et al. |
| 5,680,932 | A | 10/1997 | Dickinson et al. |
| 5,697,669 | A | 12/1997 | Yemini |
| D389,309 | S | 1/1998 | Shaw |
| 5,740,927 | A | 4/1998 | Yemini |
| 5,743,416 | A | 4/1998 | Yemini |
| 5,762,411 | A | 6/1998 | Yemini |
| 5,797,488 | A | 8/1998 | Yemini |
| 5,806,947 | A | 9/1998 | Meisner et al. |
| 5,833,065 | A | 11/1998 | Burgess |
| 5,833,409 | A | 11/1998 | Giacometti et al. |
| D402,111 | S | 12/1998 | Dickinson et al. |
| D404,916 | S | 2/1999 | Dickinson et al. |
| 5,875,828 | A | 3/1999 | Quiram et al. |
| 5,882,097 | A | 3/1999 | Kohagen et al. |
| 5,921,301 | A | 7/1999 | Quiram et al. |
| 5,988,243 | A | 11/1999 | Ayala et al. |
| 6,029,721 | A | 2/2000 | O'Banion |
| 6,039,417 | A | 3/2000 | Snoke et al. |
| 6,074,029 | A | 6/2000 | Snoke et al. |
| 6,082,538 | A | 7/2000 | Snider et al. |
| 6,140,812 | A | 10/2000 | Russell et al. |
| 6,152,552 | A | 11/2000 | Snoke et al. |
| 6,196,534 | B1 | 3/2001 | Fortin et al. |
| 6,199,608 | B1 | 3/2001 | Ayala et al. |
| 6,213,296 | B1 | 4/2001 | Streich et al. |
| 6,230,925 | B1 | 5/2001 | Hardigg et al. |
| 6,244,064 | B1 | 6/2001 | Powell et al. |
| 6,244,485 | B1 | 6/2001 | Holland et al. |
| 6,244,486 | B1 | 6/2001 | Holland et al. |
| 6,298,946 | B1 | 10/2001 | Yemini et al. |
| 6,301,901 | B1 | 10/2001 | Coffee et al. |
| 6,305,498 | B1 | 10/2001 | Itzkovitch |
| 6,318,713 | B1 | 11/2001 | Levi |
| 6,328,179 | B1 | 12/2001 | Conrado et al. |
| D453,624 | S | 2/2002 | Itzkovitch |
| 6,364,329 | B1 | 4/2002 | Holub et al. |
| 6,375,289 | B1 | 4/2002 | Yemini |
| 6,386,363 | B1 | 5/2002 | Huang |
| 6,397,436 | B1 | 6/2002 | Wang |
| 6,401,923 | B1 | 6/2002 | Huang |
| 6,405,864 | B1 | 6/2002 | Streich et al. |
| 6,415,683 | B1 | 7/2002 | Fortin et al. |
| 6,415,831 | B2 | 7/2002 | Ayala et al. |
| 6,415,924 | B1 | 7/2002 | Lee |
| 6,464,840 | B1 | 10/2002 | McCann |
| 6,474,097 | B2 | 11/2002 | Treppedi et al. |
| 6,478,463 | B2 | 11/2002 | Snider |
| 6,561,402 | B2 | 5/2003 | Holland et al. |
| 6,595,251 | B2 | 7/2003 | Ayala et al. |
| 6,648,166 | B2 | 11/2003 | Levy |
| 6,658,966 | B2 | 12/2003 | Fortin et al. |
| 6,659,440 | B2 | 12/2003 | Levy |
| 6,662,945 | B1 | 12/2003 | Chang |
| 6,675,965 | B2 | 1/2004 | Holland et al. |
| 6,675,967 | B2 | 1/2004 | Huang |
| 6,679,391 | B1 | 1/2004 | Huang |
| 6,688,407 | B2 | 2/2004 | Etter et al. |
| 6,694,631 | B2 | 2/2004 | Bone et al. |
| 6,695,142 | B2 | 2/2004 | Chen et al. |
| 6,698,609 | B2 | 3/2004 | Pangerc et al. |
| 6,712,180 | B2 | 3/2004 | Levy |
| 6,722,524 | B1 | 4/2004 | Huang et al. |
| 6,732,627 | B2 | 5/2004 | Wattenbach et al. |
| 6,745,804 | B2 | 6/2004 | Welsh et al. |
| 6,748,987 | B2 | 6/2004 | Ayala et al. |
| 6,755,302 | B1 | 6/2004 | Streich et al. |
| D493,034 | S | 7/2004 | Bar-Erez |
| 6,761,366 | B1 | 7/2004 | Klemmensen et al. |
| 6,763,678 | B2 | 7/2004 | Harper |
| 6,782,783 | B2 | 8/2004 | Shull et al. |
| 6,789,670 | B2 | 9/2004 | Cooper et al. |
| 6,803,683 | B2 | 10/2004 | Bone et al. |
| 6,810,596 | B2 | 11/2004 | Fung et al. |
| 6,832,684 | B2 | 12/2004 | Huang |
| 6,848,684 | B2 | 2/2005 | Fortin et al. |
| 6,883,793 | B2 | 4/2005 | Fortin et al. |
| D505,068 | S | 5/2005 | Cunningham et al. |
| D505,836 | S | 6/2005 | Burkholder |
| 6,966,350 | B1 | 11/2005 | Gist |
| D513,123 | S | 12/2005 | Richardson et al. |
| 6,978,890 | B2 | 12/2005 | Pangerc et al. |
| D513,451 | S | 1/2006 | Richardson et al. |
| 6,981,780 | B2 | 1/2006 | Einav |
| 7,004,349 | B2 | 2/2006 | Heiberg et al. |
| 7,017,740 | B2 | 3/2006 | Itzkovitch |
| 7,021,637 | B2 | 4/2006 | Snider et al. |

(56) References Cited

U.S. PATENT DOCUMENTS

D520,734 S 5/2006 Henning et al.
7,036,540 B2 5/2006 Welsh et al.
7,048,021 B2 5/2006 Ayala et al.
7,048,133 B2 5/2006 Pangerc et al.
7,069,662 B2 7/2006 Fung et al.
7,090,094 B2 8/2006 Wade et al.
7,090,210 B2 8/2006 Lawrence et al.
7,143,841 B2 12/2006 Etter et al.
7,165,674 B2 1/2007 Pangerc et al.
7,195,120 B2 3/2007 Cunningham et al.
7,222,767 B1 5/2007 Yang
7,225,923 B2 6/2007 Hallee et al.
7,228,983 B2 6/2007 Pangerc et al.
7,232,120 B2 6/2007 Campbell et al.
7,237,673 B2 7/2007 Wikle et al.
7,237,688 B2 7/2007 Pangerc et al.
7,246,704 B2 7/2007 Brunson et al.
7,246,718 B2 7/2007 Einav et al.
7,316,309 B2 1/2008 Streich et al.
7,322,470 B2 1/2008 Brunson
7,325,682 B2 2/2008 Seymour et al.
7,328,796 B2 2/2008 Brunson et al.
7,329,066 B2 2/2008 Pineiros et al.
7,331,456 B2 2/2008 Pengerc et al.
7,334,680 B2 2/2008 Cunningham et al.
7,370,772 B2 5/2008 Brunson
7,380,778 B2 6/2008 Lawrence et al.
7,392,591 B2 7/2008 Milligan et al.
7,404,696 B2 7/2008 Campbell
D577,488 S 9/2008 Weng et al.
D578,759 S 10/2008 Grenier et al.
7,438,084 B2 10/2008 Trettin et al.
7,451,525 B2 11/2008 Willems
7,458,784 B2 12/2008 Vos et al.
7,481,254 B2 1/2009 Welsh et al.
7,484,620 B2 2/2009 Miller et al.
7,513,056 B1 4/2009 Hobden et al.
7,516,704 B2 4/2009 Snider et al.
7,530,377 B2 5/2009 Ayala et al.
D600,912 S 9/2009 Brunner
7,588,255 B2 9/2009 Katz
7,600,640 B2 10/2009 Hallee et al.
7,748,232 B2 7/2010 Kang
7,814,947 B2 10/2010 Ayala et al.
D627,968 S 11/2010 Brunner
7,824,136 B2 11/2010 Campbell
7,845,653 B2 12/2010 Katz
7,854,321 B2 12/2010 Twig et al.
7,883,096 B2 2/2011 Katz et al.
7,891,389 B2 2/2011 Welsh et al.
7,938,412 B2 5/2011 Katz
D640,056 S 6/2011 Twig et al.
D641,160 S 7/2011 Minneman
8,038,020 B2 10/2011 Vecchio et al.
8,042,794 B2 10/2011 Marshall et al.
D648,538 S 11/2011 Reinhart et al.
D650,585 S 12/2011 Jamison et al.
8,069,984 B2 12/2011 Larson et al.
8,132,819 B2 3/2012 Landau et al.
8,152,037 B2 4/2012 Sabbag
8,152,149 B2 4/2012 Lawrence et al.
8,167,011 B2 5/2012 Quiram et al.
8,191,449 B2 6/2012 Wiezorek
8,191,910 B2 6/2012 Landau et al.
8,210,387 B2 7/2012 Twig et al.
8,210,579 B2 7/2012 Vilkomirski
8,231,119 B2 7/2012 Marshall et al.
8,256,477 B2 9/2012 Welsh et al.
8,267,245 B2 9/2012 Kotula et al.
8,297,464 B2 * 10/2012 Grenier ..... A45C 13/1084
220/314
8,307,516 B2 11/2012 Bartnick
D672,956 S 12/2012 Duvigneau
8,327,659 B2 12/2012 Winkler et al.
D674,605 S 1/2013 Vilkomirski et al.
D676,654 S 2/2013 Weremchuk et al.
8,439,165 B2 5/2013 Busschaert et al.
8,459,495 B2 6/2013 Koenig et al.
8,465,065 B2 6/2013 Browne et al.
D688,589 S 8/2013 Hung et al.
8,505,729 B2 8/2013 Sosnovsky et al.
8,567,796 B2 10/2013 Bar-Erez et al.
D693,579 S 11/2013 Weremchuk et al.
D694,522 S 12/2013 Horovitz
8,602,217 B2 12/2013 Sosnovsky et al.
8,628,280 B2 1/2014 Ceroll et al.
8,646,601 B2 2/2014 Green et al.
8,657,307 B2 2/2014 Lifshitz et al.
D701,697 S 4/2014 Sabbag et al.
D703,437 S 4/2014 Bar-Erez
8,714,355 B2 5/2014 Huang
8,740,207 B2 6/2014 Lawrence et al.
D709,697 S 7/2014 Brunner
8,763,848 B2 7/2014 Carey
D710,099 S 8/2014 Horovitz et al.
D710,102 S 8/2014 Horovitz
D710,103 S 8/2014 Horovitz
8,844,950 B2 9/2014 Greene et al.
8,875,888 B2 11/2014 Koenig et al.
8,936,258 B2 1/2015 Bar-Erez et al.
8,979,100 B2 3/2015 Bensman et al.
9,004,620 B2 4/2015 Baruch et al.
9,067,313 B2 6/2015 Green et al.
9,132,543 B2 9/2015 Bar-Erez et al.
D741,597 S 10/2015 Minneman
9,156,155 B2 10/2015 Poillot et al.
D742,640 S 11/2015 Sabbag et al.
9,205,551 B2 12/2015 Green et al.
9,238,301 B2 1/2016 Streich et al.
9,259,958 B2 2/2016 Chernyshou
9,272,345 B2 3/2016 Ayala et al.
9,272,722 B2 3/2016 Dufoure et al.
9,278,446 B2 3/2016 Lifshitz et al.
9,278,782 B2 3/2016 Fjelland
9,316,428 B2 4/2016 Mech
9,341,403 B2 5/2016 Conrad et al.
9,347,229 B2 5/2016 Ken-Dror et al.
9,371,954 B2 6/2016 Lifshitz et al.
D765,397 S 9/2016 Reinhart
D765,407 S 9/2016 Reinhart
D765,408 S 9/2016 Reinhart
D765,409 S 9/2016 Reinhart
D765,410 S 9/2016 Reinhart
D765,411 S 9/2016 Reinhart
9,469,024 B2 10/2016 Bensman et al.
9,492,919 B2 11/2016 Roehm et al.
D773,821 S 12/2016 Reinhart
D775,832 S 1/2017 Stuart et al.
D776,932 S 1/2017 Reinhart
9,561,568 B2 2/2017 Brotto
9,566,704 B1 2/2017 Stoikos et al.
9,566,990 B2 2/2017 Bar-Erez et al.
9,616,563 B2 4/2017 Vilkormirski et al.
9,636,819 B2 5/2017 Lifshitz et al.
9,643,629 B2 5/2017 Bar-Erez et al.
D792,094 S 7/2017 Stoikos et al.
D792,105 S 7/2017 Reinhart
9,724,767 B2 8/2017 Ceroll et al.
D798,054 S 9/2017 Shpitzer et al.
9,752,349 B2 9/2017 Weber et al.
9,770,822 B2 9/2017 Sabbag et al.
9,776,319 B2 10/2017 Schell et al.
9,796,076 B2 10/2017 Baruch
9,839,327 B1 12/2017 Gordon
D809,779 S 2/2018 Muriithi
9,890,993 B1 2/2018 Sandberg
9,937,568 B2 4/2018 Ceroll et al.
D816,492 S 5/2018 Reinhart
9,962,825 B2 5/2018 Gonzales et al.
10,022,856 B2 7/2018 Bensman et al.
10,045,606 B2 8/2018 Cirincione, II et al.
10,058,992 B2 8/2018 Welsh et al.
RE47,022 E 9/2018 Sosnovsky et al.
D828,028 S 9/2018 Seiders et al.

(56) References Cited

U.S. PATENT DOCUMENTS

| | | | |
|---|---|---|---|
| D828,029 | S | 9/2018 | Seiders et al. |
| 10,065,304 | B2 | 9/2018 | Bensman et al. |
| D831,352 | S | 10/2018 | Brunner |
| 10,093,017 | B2 | 10/2018 | Birnbaum et al. |
| 10,106,180 | B2 | 10/2018 | Bar-Erez et al. |
| 10,109,169 | B2 | 10/2018 | Chevalier et al. |
| 10,118,265 | B2 | 11/2018 | Brotto |
| 10,127,418 | B2 | 11/2018 | Demaretz |
| 10,136,722 | B1 | 11/2018 | Cirincione, II et al. |
| 10,160,471 | B2 | 12/2018 | Yahav et al. |
| D837,516 | S | 1/2019 | Shpitzer |
| 10,173,272 | B2 | 1/2019 | Ceroll et al. |
| D844,983 | S | 4/2019 | Brunner |
| D846,880 | S | 4/2019 | Shuai et al. |
| D847,511 | S | 5/2019 | Shuai et al. |
| D851,929 | S | 6/2019 | Shpitzer |
| 10,322,867 | B2 | 6/2019 | Furneaux et al. |
| 10,343,274 | B2 | 7/2019 | Katz et al. |
| 10,345,026 | B2 | 7/2019 | Fire |
| 10,357,874 | B2 | 7/2019 | Engvall et al. |
| 10,363,614 | B2 | 7/2019 | O'Sullivan et al. |
| D857,386 | S | 8/2019 | Shpitzer |
| D857,387 | S | 8/2019 | Shpitzer |
| D857,388 | S | 8/2019 | Shpitzer |
| 10,369,670 | B2 | 8/2019 | Brotto |
| 10,399,748 | B2 | 9/2019 | Reinhart |
| 10,401,075 | B2 | 9/2019 | Bond |
| 10,406,673 | B2 | 9/2019 | Shechtman et al. |
| D861,345 | S | 10/2019 | Brunner |
| 10,443,918 | B2 | 10/2019 | Li et al. |
| 10,492,631 | B2 | 12/2019 | Velderman et al. |
| 10,500,713 | B2 | 12/2019 | Velderman et al. |
| D872,478 | S | 1/2020 | Seiders et al. |
| D872,485 | S | 1/2020 | Seiders et al. |
| 10,524,590 | B2 | 1/2020 | Wu et al. |
| 10,524,592 | B2 | 1/2020 | Sergyeyenko et al. |
| 10,562,174 | B2 | 2/2020 | Omry et al. |
| 10,575,417 | B2 | 2/2020 | Sabbag et al. |
| D878,054 | S | 3/2020 | Reinhart et al. |
| 10,576,616 | B2 | 3/2020 | Hays et al. |
| 10,603,783 | B2 | 3/2020 | Brocket et al. |
| 10,654,042 | B2 | 5/2020 | Rethwisch et al. |
| 10,710,770 | B2 | 7/2020 | Kogel et al. |
| 10,723,502 | B2 | 7/2020 | Berkbigler |
| 10,787,186 | B2 | 9/2020 | Bar-Erez et al. |
| 10,829,269 | B2 | 11/2020 | Gonitianer et al. |
| 10,836,543 | B2 | 11/2020 | Yu et al. |
| 10,843,327 | B2 | 11/2020 | Etzinger |
| D904,829 | S | 12/2020 | Nichols et al. |
| D907,445 | S | 1/2021 | Nichols et al. |
| D920,743 | S | 6/2021 | Meda et al. |
| 11,020,849 | B2 | 6/2021 | Vetter et al. |
| 11,047,609 | B2 | 6/2021 | Maier |
| 11,104,484 | B2 | 8/2021 | Slattery |
| 11,203,465 | B2 | 12/2021 | Seiders et al. |
| D946,279 | S | 3/2022 | Seiders et al. |
| D968,083 | S | 11/2022 | Hsu |
| D968,092 | S | 11/2022 | Hsu |
| D985,937 | S | 5/2023 | Bullock et al. |
| D994,438 | S | 8/2023 | Bullock et al. |
| D996,819 | S | 8/2023 | Ludwig et al. |
| 11,912,477 | B2 | 2/2024 | Miller et al. |
| D1,024,557 | S | 4/2024 | Miller et al. |
| D1,036,116 | S | 7/2024 | Miller et al. |
| D1,036,119 | S | 7/2024 | Miller et al. |
| D1,063,376 | S | 2/2025 | Miller et al. |
| 2002/0117507 | A1* | 8/2002 | Doerfler ..... A45C 13/12 220/835 |
| 2003/0106821 | A1 | 6/2003 | Bar-Erez |
| 2004/0025531 | A1 | 2/2004 | Holloman-Hughes et al. |
| 2004/0134818 | A1 | 7/2004 | Cunningham et al. |
| 2004/0262319 | A1 | 12/2004 | Fisher |
| 2005/0155889 | A1 | 7/2005 | Lown |
| 2006/0065655 | A1 | 3/2006 | Taylor |
| 2006/0075757 | A1 | 4/2006 | Yuen |
| 2006/0249412 | A1 | 11/2006 | Hernandez et al. |
| 2007/0032774 | A1 | 2/2007 | Glade et al. |
| 2008/0067095 | A1 | 3/2008 | Mueller |
| 2008/0067206 | A1 | 3/2008 | Kuhn |
| 2011/0203328 | A1 | 8/2011 | Vilkomirski et al. |
| 2012/0168444 | A1 | 7/2012 | Shitrit et al. |
| 2013/0127129 | A1 | 5/2013 | Bensman et al. |
| 2014/0069832 | A1 | 3/2014 | Roehm |
| 2014/0102928 | A1 | 4/2014 | Sabbag et al. |
| 2014/0319147 | A1 | 10/2014 | Horovitz et al. |
| 2016/0183651 | A1 | 6/2016 | Tonelli |
| 2017/0197765 | A1 | 7/2017 | Hu et al. |
| 2017/0259424 | A1 | 9/2017 | Vetter et al. |
| 2019/0128589 | A1 | 5/2019 | Adams et al. |
| 2019/0161240 | A1 | 5/2019 | Ahlstrom et al. |
| 2019/0210213 | A1 | 7/2019 | Omry et al. |
| 2019/0241349 | A1 | 8/2019 | Pearson et al. |
| 2020/0061802 | A1 | 2/2020 | Samsel et al. |
| 2020/0148428 | A1 | 5/2020 | Georgiadis et al. |
| 2020/0216229 | A1 | 7/2020 | Guan et al. |
| 2020/0217571 | A1 | 7/2020 | Guan et al. |
| 2020/0217574 | A1 | 7/2020 | Thelin et al. |
| 2020/0217575 | A1 | 7/2020 | Thelin et al. |
| 2020/0217576 | A1 | 7/2020 | Guan et al. |
| 2020/0217578 | A1 | 7/2020 | Wang et al. |
| 2021/0016955 | A1 | 1/2021 | Morine et al. |
| 2021/0039846 | A1* | 2/2021 | Jinkins ..... B65D 51/18 |
| 2021/0102409 | A1 | 4/2021 | Seiders et al. |

FOREIGN PATENT DOCUMENTS

| | | | |
|---|---|---|---|
| CA | 140850 | S | 1/2012 |
| CN | 301636876 | | 8/2011 |
| CN | 301636878 | | 8/2011 |
| CN | 301716880 | S | 11/2011 |
| CN | 303015503 | S | 12/2014 |
| CN | 303313142 | S | 8/2015 |
| CN | 303381335 | S | 9/2015 |
| CN | 303381336 | S | 9/2015 |
| CN | 303381338 | | 9/2015 |
| CN | 303381344 | S | 9/2015 |
| CN | 303381345 | S | 9/2015 |
| CN | 303390865 | | 9/2015 |
| CN | 104972449 | A | 10/2015 |
| CN | 204776397 | U | 11/2015 |
| CN | 105173301 | A | 12/2015 |
| CN | 303514744 | S | 12/2015 |
| CN | 205686756 | U | 11/2016 |
| CN | 207841271 | U | 9/2018 |
| CN | 207983304 | U | 10/2018 |
| CN | 208773531 | U | 4/2019 |
| CN | 208773532 | U | 4/2019 |
| CN | 109952155 | A | 6/2019 |
| CN | 305865230 | | 6/2020 |
| CN | 305936321 | | 7/2020 |
| CN | 305943857 | | 7/2020 |
| CN | 305976551 | | 8/2020 |
| CN | 306022334 | | 9/2020 |
| CN | 306022419 | | 9/2020 |
| CN | 306082192 | | 10/2020 |
| CN | 306109929 | | 10/2020 |
| CN | 306114942 | | 10/2020 |
| CN | 306114943 | | 10/2020 |
| CN | 212421237 | U | 1/2021 |
| CN | 212497679 | U | 2/2021 |
| CN | 212609378 | U | 2/2021 |
| CN | 212706692 | U | 3/2021 |
| CN | 212706697 | U | 3/2021 |
| CN | 214932437 | U | 11/2021 |
| CN | 217674229 | U | 10/2022 |
| CN | 113753399 | A | 7/2023 |
| DE | 1955836 | U | 2/1967 |
| DE | 4125184 | A1 | 2/1993 |
| DE | 202015106823 | U1 | 3/2017 |
| DE | 202015106824 | U1 | 3/2017 |
| DE | 102018005857 | A1 | 1/2020 |
| EM | 007720156-0002 | | 7/2020 |
| EM | 007720156-0003 | | 7/2020 |
| EM | 007720206-0001 | | 7/2020 |

(56) References Cited

FOREIGN PATENT DOCUMENTS

| | | | |
|---|---|---|---|
| EM | 008052013-0004 | | 8/2020 |
| EP | 1442845 | A1 | 8/2004 |
| EP | 1584425 | A1 | 10/2005 |
| EP | 1878667 | A1 | 1/2008 |
| EP | 2474393 | A2 | 7/2012 |
| EP | 3502387 | B1 | 10/2020 |
| EP | 3877283 | A1 | 9/2021 |
| JP | S48-057405 | U | 7/1973 |
| JP | H08205919 | A | 8/1996 |
| JP | H08326143 | A | 12/1996 |
| JP | 2001204348 | A | 7/2001 |
| JP | 4362188 | B2 | 11/2009 |
| JP | 4500103 | B2 | 7/2010 |
| JP | 3167726 | U | 5/2011 |
| JP | D1433757 | | 2/2012 |
| JP | 5838147 | B2 | 12/2015 |
| JP | D1590075 | | 11/2017 |
| JP | 6420069 | B2 | 11/2018 |
| JP | D1619392 | | 12/2018 |
| JP | D1625514 | | 2/2019 |
| JP | 2019080532 | A | 5/2019 |
| KR | 101797564 | B1 | 11/2017 |
| KR | 20180000510 | U | 2/2018 |
| WO | D036814-001 | | 8/1996 |
| WO | D037170-001 | | 10/1996 |
| WO | D037170-002 | | 10/1996 |
| WO | 2006019314 | A1 | 2/2006 |
| WO | 2011135559 | A1 | 11/2011 |
| WO | 2012107125 | A1 | 8/2012 |

OTHER PUBLICATIONS

Dec. 16, 2024—(AU) First Examination Report—App. No. 2023283819.

Mar. 17, 2025—(CN) First Office Action—App. No. 202380045707.1.

Apr. 20, 2025—(KR) First Office Action—App. No. 1020257000018.

Mar. 13, 2025—(MY) Examiner's Search Report—App. No. PI2024007055.

bhphotovideo.com, "Nanuk 960 Protective Rolling Case with Dividers and Organizer (Black)," visited on Jun. 16, 2020 at https://www.bhphotovideo.com/c/product/1504703-REG/nanuk_960_6001_960_waterproof_hard_case.html.

homedepot.com, "Husky 37-in Rolling Tool Box Utility Cart Black," visited on Jun. 16, 2020 at https://www.homedepot.com/p/Husky-37-in-Rolling-Tool-Box-Utility-Cart-Black-209261/203668066.

lowes.com, "Craftsman 37-in Black Plastic Wheeled," visited on Jun. 16, 2020 at https://www.lowes.com/pd/CRAFTSMAN-37-in-Black-Plastic-Wheeled-Lockable-Tool-Box/1000578337.

Image of Container retrieved on Jun. 7, 2022 at https://toolguyd.com/blog/wp-content/uploads/2017/06/Milwaukee-Packout-Tool-Storage-Roller-Tool-Cart-Open-Lid-with-Tool-Tote.jpg.

Nov. 15, 2023—(WO) International Search Report & Written Opinion—PCT/US2023/068043.

West Marine, "Plano Shallow Dry Storage Tackle Box", First reviewed "12 Years ago"—Nov. 29, 2011. (https://www.westmarine.com/plano-shal low-dry-storage-tackle-box-1997246.html) (Year: 2011).

Amazon.ca, "YETI LoadOut 15 GoBox Divided Cargo Case, Charcoal", First on sale Jan. 17, 2023. (https://www.amazon.ca/ YETI-LoadOut-GoBox-Divided-Cargo/dp/BOBSJH6WMX/) (Year: 2023).

GearJunkie, "YETI Launches a Burly Cargo Crate, the LoadOut GoBox", Published Apr. 30, 2019. (https://gearjunkie.com/camping/ yeti-loadout-gobox) (Year: 2019).

Image of Plano Dry-Storage Box. The photograph cited depicts a container to provide to the Patent Office for consideration. For purposes of prosecution, the product depicted in this photograph was in the public domain on or before Jun. 8, 2022.

Image of Engle Drybox Cooler. The photograph cited depicts a container to provide to the Patent Office for consideration. For purposes of prosecution, the product depicted in this photograph was in the public domain on or before Jun. 8, 2022.

Image of Flambeau 6415SB Compact Ammo Can. The photograph cited depicts a container to provide to the Patent Office for consideration. For purposes of prosecution, the product depicted in this photograph was in the public domain on or before Jun. 8, 2022.

Image of Harbor Freight .50 Cal Metal Ammo Can. The photograph cited depicts a container to provide to the Patent Office for consideration. For purposes of prosecution, the product depicted in this photograph was in the public domain on or before Jun. 8, 2022.

Image of Nanuk 915 Case. The photograph cited depicts a container to provide to the Patent Office for consideration. For purposes of prosecution, the product depicted in this photograph was in the public domain on or before Jun. 8, 2022.

Image of Pelican Air 1485. The photograph cited depicts a container to provide to the Patent Office for consideration. For purposes of prosecution, the product depicted in this photograph was in the public domain on or before Jun. 8, 2022.

Image of Pelican Protector 1430. The photograph cited depicts a container to provide to the Patent Office for consideration. For purposes of prosecution, the product depicted in this photograph was in the public domain on or before Jun. 8, 2022.

Image of Pelican Vault V250 Ammo Case. The photograph cited depicts a container to provide to the Patent Office for consideration. For purposes of prosecution, the product depicted in this photograph was in the public domain on or before Jun. 8, 2022.

Image of Plano Element-Proof Field Ammo Box Large with Tray. The photograph cited depicts a container to provide to the Patent Office for consideration. For purposes of prosecution, the product depicted in this photograph was in the public domain on or before Jun. 8, 2022.

Image of Sheffield Plastic Field Box. The photograph cited depicts a container to provide to the Patent Office for consideration. For purposes of prosecution, the product depicted in this photograph was in the public domain on or before Jun. 8, 2022.

Image of SKB iSeries 1309. The photograph cited depicts a container to provide to the Patent Office for consideration. For purposes of prosecution, the product depicted in this photograph was in the public domain on or before Jun. 8, 2022.

Dec. 10, 2025—(JP) First Office Action—App. No. 2024-570942.

* cited by examiner

CONTAINER WITH HANDLE AND LATCHING SYSTEM

CROSS-REFERENCE TO RELATED APPLICATIONS

This application is a divisional of U.S. patent application Ser. No. 17/835,849, filed Jun. 8, 2022, entitled Container with Handle and Latching System, the contents of which is herein incorporated by reference in its entirety.

FIELD OF INVENTION

This disclosure relates to containers, latching systems, and handle assemblies.

BACKGROUND

Various types of containers and latching systems exist. Containers may be used for food, beverages, and other materials or items. Latching systems exist to lock the containers in a closed configuration. However, conventional containers and latching systems are often not very durable and may not be easy to use. For instance, containers may not be strong enough to hold certain items and may not be strong enough to hold items on top of the container. Additionally, some latching systems may engage when a user does not want the system engaged and in other cases may not provide a sufficient lock between for the container. Some containers also may include handles to assist a user in carrying or moving the container. These handles need to be easily gripped and or moved into a position to be easily gripped when needed. In such arrangements, these and other deficiencies may render the container and/or latching system virtually useless.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

One aspect of this disclosure may relate to a container comprising: (1) a base portion including: (a) a sidewall structure having a first side, a second side opposite the first side, the sidewall structure having a first end and a second end; (b) a bottom portion connected to a first end of the sidewall structure; and (c) an opening formed at the second end of the sidewall structure, opposite the first end, where the opening is configured to allow access to an interior void of the container formed by the sidewall structure and the bottom portion; and (2) a lid connected to the base portion, where the lid has an open configuration and a closed configuration. The lid may be configured to cover the opening formed at the second end of the sidewall structure when the container is in the closed configuration, and configured to allow access to the opening when the container is in the closed configuration. The lid may include a handle assembly comprising a handle that has a stowed position where the handle is generally parallel to an upper surface of the lid, and a carry position where the handle is generally perpendicular to the upper surface of the lid. The handle may be maintained in the stowed position until acted upon by a first force greater than a threshold force to move the handle from the stowed position to the carry position; and when the handle is in the carry position, the handle may be maintained in the carry position until acted upon by a second force greater than the threshold force to move the handle from the carry position to the stowed position. The handle may be recessed in a cavity formed in the upper surface of the lid, where the cavity includes a pair of mounts that extend from an outward facing surface of the cavity, and the handle is connected to the pair of mounts. In some examples, the pair of mounts may also connect to a rear surface of the cavity. The handle may include a grip portion and a pair of legs, where each leg has a fixed end connected to an end of the grip portion, and a free end opposite the fixed end, with a pocket located near the free end. The handle may be recessed in a cavity formed in the upper surface of the lid, and the pocket of each leg may receive a biasing member and a plunger, where the plunger comprises a recess at a first end that receives the biasing member and a first plurality of engaging members at a second end opposite the first end. The cavity may include a pair of side surfaces, where each side surface of the pair of side surfaces includes a receiver, and the receiver may receive a detent member that includes a second plurality of engaging members. The first plurality of engaging members may engage the second plurality of engaging members to maintain the handle in either the stowed position or the carry position. The biasing member may exert a third force on the plunger to engage the plunger with the detent member. The first plurality of engaging members may comprise a plurality of protrusions, a plurality of recesses, where each protrusion is connected to an adjacent recess with a ramped surface between each protrusion and each recess.

Other aspects of this disclosure may relate to a container comprising: (1) a base portion that includes: (a) a sidewall structure having a first side, a second side opposite the first side, where the sidewall structure having a first end and a second end; (b) a bottom portion connected to a first end of the sidewall structure; and (c) an opening formed at the second end of the sidewall structure, opposite the first end, where the opening being configured to allow access to an interior void of the container formed by the sidewall structure and the bottom portion; and (2) a lid pivotally connected to the base portion with a hinge, where the lid has an open configuration and a closed configuration. The lid may be configured to cover the opening formed at the second end of the sidewall structure when the container is in the closed configuration, and configured to allow access to the opening when the container is in the closed configuration. The container may also include a latch assembly pivotally connected to the lid opposite the hinge, the latch assembly having a locked position and an unlocked position, the latch assembly comprising a latch body pivotally connected to the lid and an activating member pivotally connected to the latch body, where the activating member is rotated relative to the latch body to move the latch assembly from the locked position to the unlocked position. In addition, the base portion may include a first raised portion adjacent the latch assembly and a second raised portion adjacent the hinge. The container may also include a first latch guard connected to the first raised portion, where the first latch guard comprises a first arm extending from the first raised portion and a first cross-member located a first predetermined distance below the latch assembly, where the first cross-member acts as a first fixed handle. In addition, the container may include a second latch guard connected to the second raised portion, where the second latch guard comprises a second arm extending from the second raised portion and a second cross-member located a second predetermined distance below the hinge, where the second cross-member acts as a second fixed handle. The first cross-member may have a concave lower surface, where the concave lower surface may include a plurality of ribs. The lid may comprise a movable handle assembly comprising a handle and a plunger that includes a biasing member, where the handle includes a grip portion and a pair of legs. Each leg of the pair of legs may include a pocket that receives the plunger. The handle has a stowed position and a carry position such that the handle is maintained in the stowed position until acted upon by a first force greater than a threshold force to move the handle from the stowed position to the carry position. Similarly, when the handle is in the carry position, the handle may be maintained in the carry position until acted upon by a second force greater than the threshold force to move the handle from the carry position to the stowed position. Each leg of the pair of legs may be attached to a mount that extends from an outward facing surface of the lid. The handle may be recessed in a cavity on an upper surface of the lid, where the cavity includes a side surface with a receiver. The receiver may receive a detent member that includes a second plurality of engaging members. The plunger may include a first plurality of engaging members that engages the second plurality of engaging members to maintain the handle in either the stowed position or the carry position.

Still additional aspects of this disclosure may relate to a container comprising: (1) a base portion comprising: (a) a sidewall structure having a first side, a second side opposite the first side, where the sidewall structure having a first end and a second end; (b) a bottom portion connected to a first end of the sidewall structure; and (c) an opening formed at the second end of the sidewall structure, opposite the first end, the opening being configured to allow access to an interior void of the container formed by the sidewall structure and the bottom portion; (2) a lid connected to the base portion, where the lid has an open configuration and a closed configuration, and (3) a latch assembly pivotally connected to the lid, where the latch assembly having a locked position and an unlocked position. The lid may be configured to cover the opening formed at the second end of the sidewall structure when the container is in the closed configuration, and may be configured to allow access to the opening when the container is in the closed configuration. The lid may include a handle assembly comprising a handle, a plunger that includes a biasing member, and a detent member, where the handle includes a grip portion and a pair of legs. Each leg of the pair of legs may include a pocket that receives the biasing member and the plunger; where the handle has a stowed position and a carry position. The detent member may be located in a receiver on the lid, and the detent member may engage the plunger to maintain the handle in the stowed position until acted upon by a first force greater than a threshold force to move the handle from the stowed position to the carry position. In addition, when the handle is in the carry position, the detent member may engage the plunger to maintain the handle in the carry position until acted upon by a second force greater than the threshold force to move the handle from the carry position to the stowed position. Each leg of the pair of legs may be connected to a mount that extends from an outward facing surface of the lid. In some examples, the container may include a latch guard with a pair of arms and a cross-member, where the cross-member is located a predetermined distance below the latch assembly and acts as a first fixed handle.

Yet other aspects of this disclosure may relate to a container, comprising: (1) a base portion comprising: (a) a sidewall structure having a first side, a second side opposite the first side, where the sidewall structure having a first end and a second end; (b) a bottom portion connected to a first end of the sidewall structure; and (c) an opening formed at the second end of the sidewall structure, opposite the first end, where the opening is configured to allow access to an interior void of the container formed by the sidewall structure and the bottom portion; (2) a lid pivotally connected to the base portion with a hinge, where the lid has an open configuration and a closed configuration; and (3) a latch assembly pivotally connected to the lid opposite the hinge, where the latch assembly includes a locked position and an unlocked position. The lid may be configured to cover the opening formed at the second end of the sidewall structure when the container is in the closed configuration, and configured to allow access to the opening when the container is in the closed configuration. The latch assembly may comprise a latch body pivotally connected to the lid, an activating member pivotally connected to the latch body, and a locking button connected to the latch body. The locking button may have a locked state that prevents the latch assembly from moving to an unlocked state and an unlocked state that allows the latch assembly to move into the unlocked position. The activating member may be rotated relative to the latch body to move the latch assembly from the locked position to the unlocked position. The latch assembly may require that both the activating member and the locking button be engaged to move the latch assembly from the locked position to the unlocked position. When the locking button is in the locked state, a movable locking member of the latch assembly may be prevented from moving relative to the latch body. The locking button may be connected to a key member that is received in a slot of the movable locking member.

BRIEF DESCRIPTION OF THE DRAWINGS

The present invention is illustrated by way of example and not limited in the accompanying figures in which like reference numerals indicate similar elements and in which.

Figure 1:
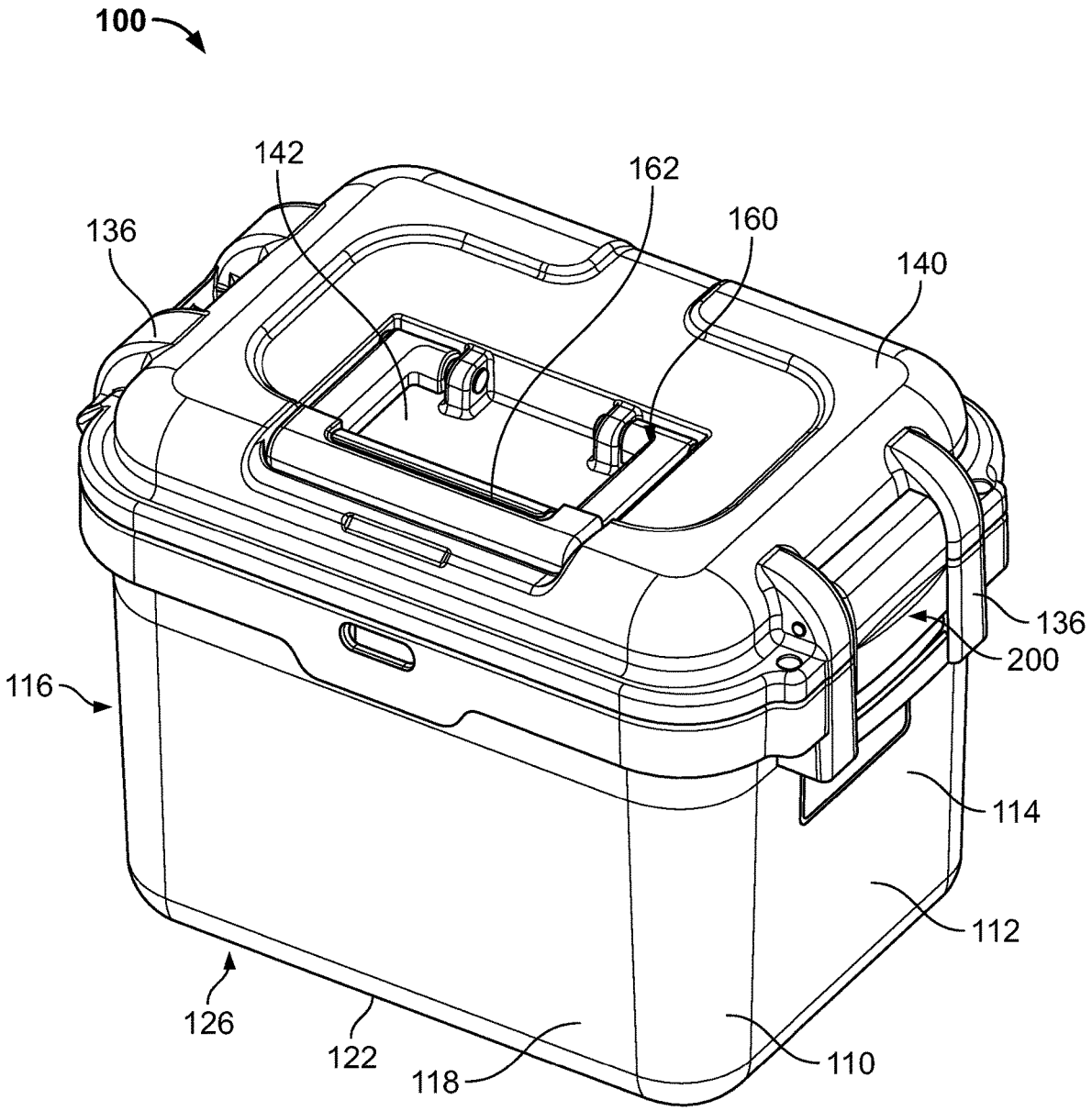
FIG. 1 illustrates a top perspective view of a container in a closed position according to one or more aspects described herein.

Further, it is to be understood that the drawings may represent the scale of different components of one single embodiment; however, the disclosed embodiments are not limited to that particular scale.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. "Generally parallel" may be used to indicate that a first line, segment, plane, edge, surface, etc. is approximately (in this instance, within 5%) equidistant from another line, plane, edge, surface, etc., over at least 50% of the length of the first line, segment, plane, edge, surface, etc. "Generally perpendicular" may be used to indicate that a first line, segment, plane, edge, surface, etc. is approximately (in this instance, within 5%) 90 degrees with another line, plane, edge, surface, etc., over at least 50% of the length of the first line, segment, plane, edge, surface, etc. Additionally, the term "plurality," as used herein, indicates any number greater than one, either disjunctively or conjunctively, as necessary, up to an infinite number. Nothing in this specification should be construed as requiring a specific three-dimensional orientation of structures in order to fall within the scope of this invention. Also, the reader is advised that the attached drawings are not necessarily drawn to scale.

In general, aspects of this invention relate to containers, latching assemblies, and handle assemblies for containers. According to various aspects and embodiments, the containers, latching assemblies, and handle assemblies described herein may be formed of one or more of a variety of materials, such as metals (including metal alloys), polymers, and composites, and may be formed in one of a variety of configurations, without departing from the scope of the invention. It is understood that the containers, latching assemblies, and handle assemblies may contain components made of several different materials. Additionally, the components may be formed by various forming methods. For example, metal components, may be formed by forging, molding, casting, stamping, machining, and/or other known techniques. Additionally, polymer components, such as elastomers, can be manufactured by polymer processing techniques, such as various molding, such as injection molding, and casting techniques and/or other known techniques.

The various figures in this application illustrate examples of containers, latching assemblies, and handle assemblies according to this invention. When the same reference number appears in more than one drawing, that reference number is used consistently in this specification and the drawings refer to the same or similar parts throughout.

Figure 2A:
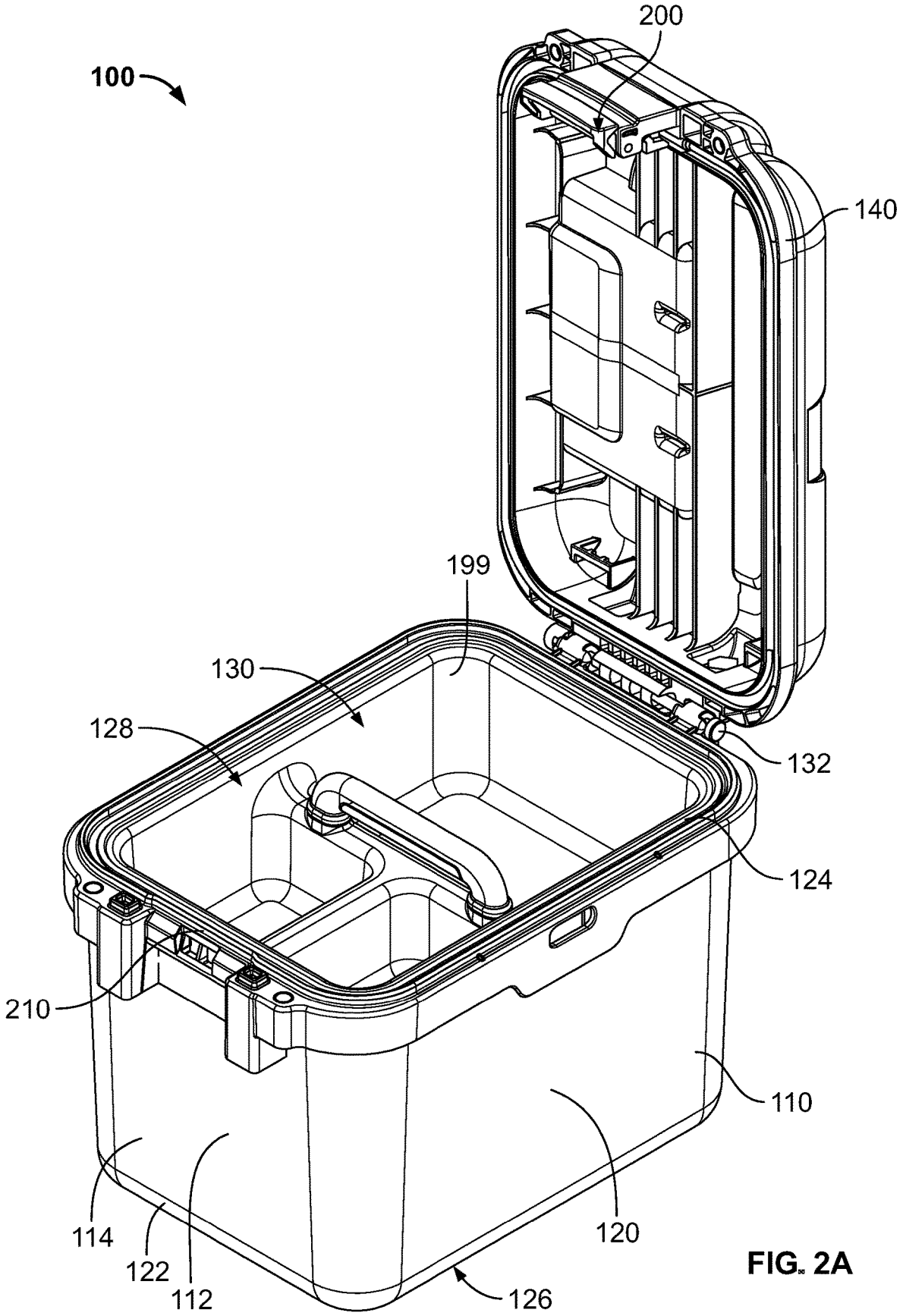
FIG. 2A illustrates a top perspective view of the container of FIG. 1 with in an open position according to one or more aspects described herein.
Figure 2B:
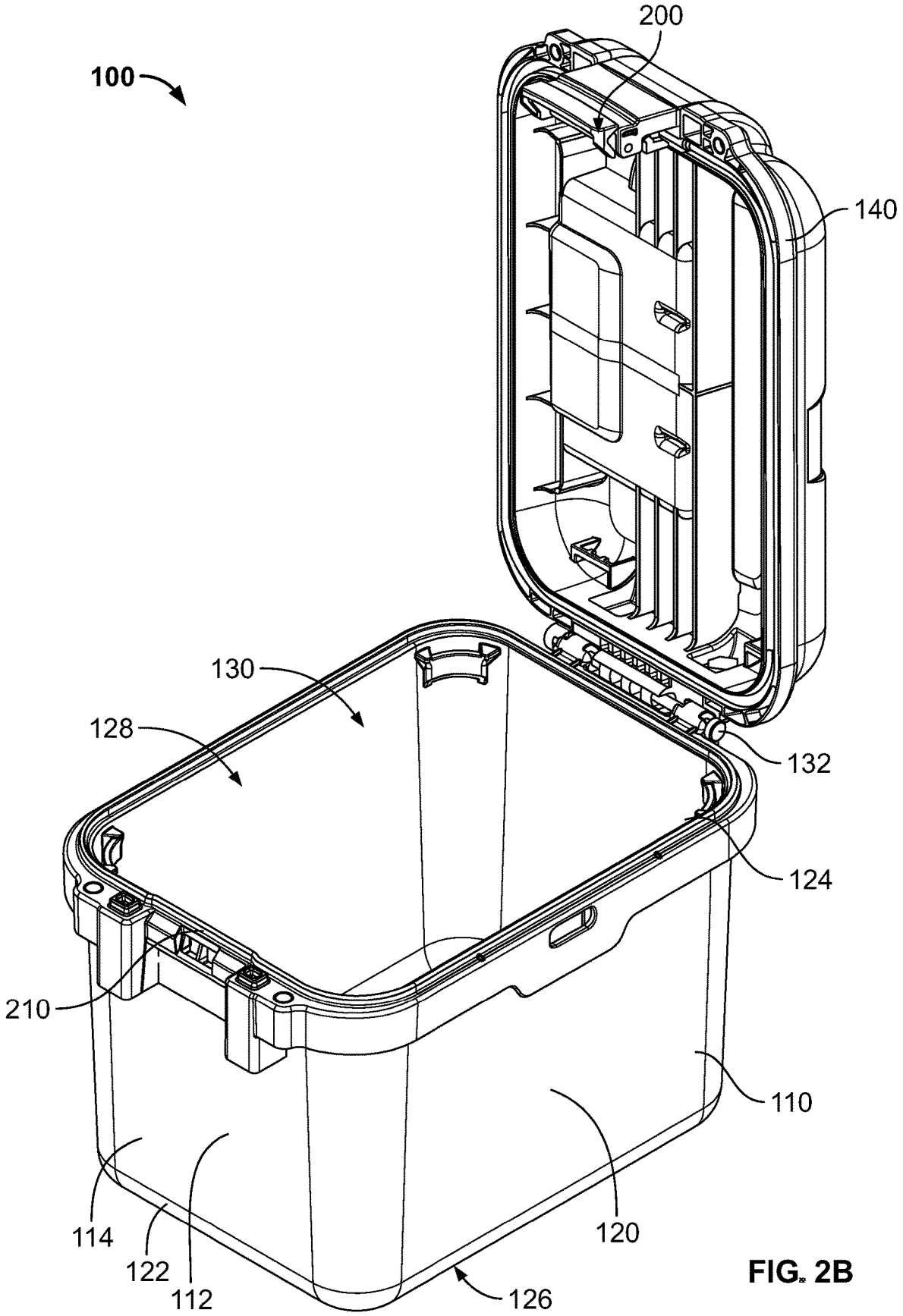
FIG. 2B illustrates a top perspective view of the container of FIG. 1 with in an open position according to one or more aspects described herein.

FIGS. 1-2B depict perspective views of a container 100. In one example, the container 100 may comprise a base portion 110 and a lid 140 that, in some examples, may be coupled, or in some examples may be non-destructively, removably coupled, thereto. The base portion 110 may be a structure forming a void for containing articles, as will be discussed more fully herein. In some examples, the base portion 110 may be cuboidal or substantially cuboidal in shape. In other examples, the base portion 110 may be prismoidal or substantially prismoidal (e.g., a pentagonal prism, hexagonal prism, heptagonal prism, or the like) in shape. In still other examples, the base portion 110 may be substantially cylindrical in shape or may have a substantially trapezoidal cross section. Various other shapes may be used without departing from the invention.

The base portion 110 may include a sidewall structure 112 having a first side 114, a second side 116 opposite the first side 114, a third side 118 extending between an edge of the first side and an edge of the second side, and a fourth side 120 opposite the third side 118. The sidewall structure 112 may also have a first end 122 and a second end 124. The sidewall structure 112 may also include a bottom portion 126 connected to a first end 122 of the sidewall structure 112 and configured to support the container on a surface such as a table, the ground, a vehicle bed, or the like. In some examples, the bottom portion 126 may also and/or alternatively include one or more feet which may support the container 100 on a surface such as a table, the ground, a vehicle bed, or the like. The feet may be integrally formed with the base portion 110 or may be attached to the base portion 110 after the base portion 110 has been formed.

The base portion 110 further includes a second end 124 defining an opening 128 (shown in FIGS. 2A-2B). The opening 128 is configured to allow access to an interior void 130 of the container 100 formed by the sidewall structure 112 and the bottom portion 126. In some examples, the void 130 may hold items such as a caddy 199 shown in FIG. 2A.

The container 100 may include a lid 140. The lid 140 is pivotable between an open configuration and closed configuration. In some embodiments rotating the lid from the closed configuration to the open configuration includes rotating the lid about 90° from the closed configuration, or about 180° from the closed configuration, or about 270° from the closed configuration. As shown in FIG. 1, the opening 128 may be covered by lid 140, when the container is in use (e.g., when the container is in a closed configuration). In some arrangements, the lid 140 may connect to the base portion 110 in a closed configuration using a press fit. Additionally, or alternatively, other securing systems or devices may be used to secure the lid 140 to the base portion 110, as will be discussed more fully herein.

In some examples, the lid 140 may be hinged such that it is connected to (either removably or permanently) the base portion 110 at a hinge 132 and may be rotated about the hinge 132. The hinge 132 may be one of various types of hinges, including a continuous piano hinge, double hinge, ball joint hinge, living hinge, and the like. These and various other hinge arrangements may be discussed more fully herein. The hinge 132 may permit the lid 140 to be opened and rotated away from the base portion 110, to allow access to the void 130 defined by the base portion 110 (e.g., via opening 128). That is, the hinge 132 may facilitate rotation of the lid 140 from a closed configuration of the container (e.g., when the lid is in place covering the void 130 formed by the base portion 110, as shown in FIG. 1) to an open configuration (e.g., when the lid is not covering the void 130 formed by the base portion 110, as shown in FIGS. 2A-2B), and vice versa.

In addition, in some arrangements, the container 100 may include a gasket 134 or other sealing device. The gasket 134 may be arranged in either the lid 140 or the base portion 110 and may aid in sealing the lid 140 and base portion 110 when the lid 140 is in a closed configuration. In one example, the container 100 may be manufactured such that it is dust tight when tested for 8 hours and/or waterproof when tested for 30 minutes under 1 meter of water. In some embodiments, the container 100 may be capable of achieving an IP67 (as set forth by International Electrotechnical Commission) rating which specifies that there is no ingress of dust or complete protection from dust when tested for 8 hours and ingress of water in harmful quantities is not possible when the enclosure is immersed in water under defined conditions of pressure and time (up to 1 m of submersion). The IP67 dust test is 8 hours long and the enclosure is tested in a vacuum. The IP67 water test is 30 minutes long and the enclosure is tested with the lowest point of the enclosure 1000 mm below the surface of the water, or the highest point 1500 mm below the surface whichever is deeper.

In some examples, the gasket 134 may be seated in a recess formed in at least one of the base portion 110 and the lid 140 and extending around a perimeter of the at least one of the base portion 110 or the lid 140. Additionally, in some example, the container 100 may include a ridge in the opposite of the base portion 110 or the lid 140 and extending around a perimeter of the base portion 110 or the lid 140. The gasket 134 may be placed between the recess and the ridge. The gasket 134 may aid in maintaining a seal between the interior of the container 100 and the outside environment, and in some examples may aid in maintaining the temperature of the articles contained within the container 100. In some examples, the gasket 134 may be a traditional gasket having a substantially circular cross section. In some examples, the gasket 134 may have a different cross-sectional shape, such as a donut or ring shape, an oval shape, a Y-shape, a U-shape, or other shape known to one skilled in the art. In other arrangements, the gasket 134 may include strategically placed cut-outs that may reduce or eliminate a need for a vent (e.g., a vent to prevent lid lock).

The container 100 may be configured to contain, store, carry, etc., items including food, beverages, or any other items. Additionally, or alternatively, the container 100 may be configured to store materials in a solid or a gaseous state, or combinations thereof, without departing from the scope of the disclosure described herein.

The container 100 including the base portion 110 and lid 140 may be formed from various materials, such as one or more metals, alloys, polymers, ceramics, or fiber-reinforced materials. In some examples, the base portion 110 and lid 140 may be formed of a polymeric material, such as polyethylene, that is molded to form both the base portion 110 and the lid 140. In some arrangements, the outer shells of the base portion 110 and the lid 140 are formed using injection molding or roto-molding/rotational molding processes as would be understood by one of ordinary skill in the art (not shown). However, various other types of molding or other manufacturing processes (e.g., stamping, casting, forging, and the like) may be used to form the container 100 without departing from the invention.

Figure 3:
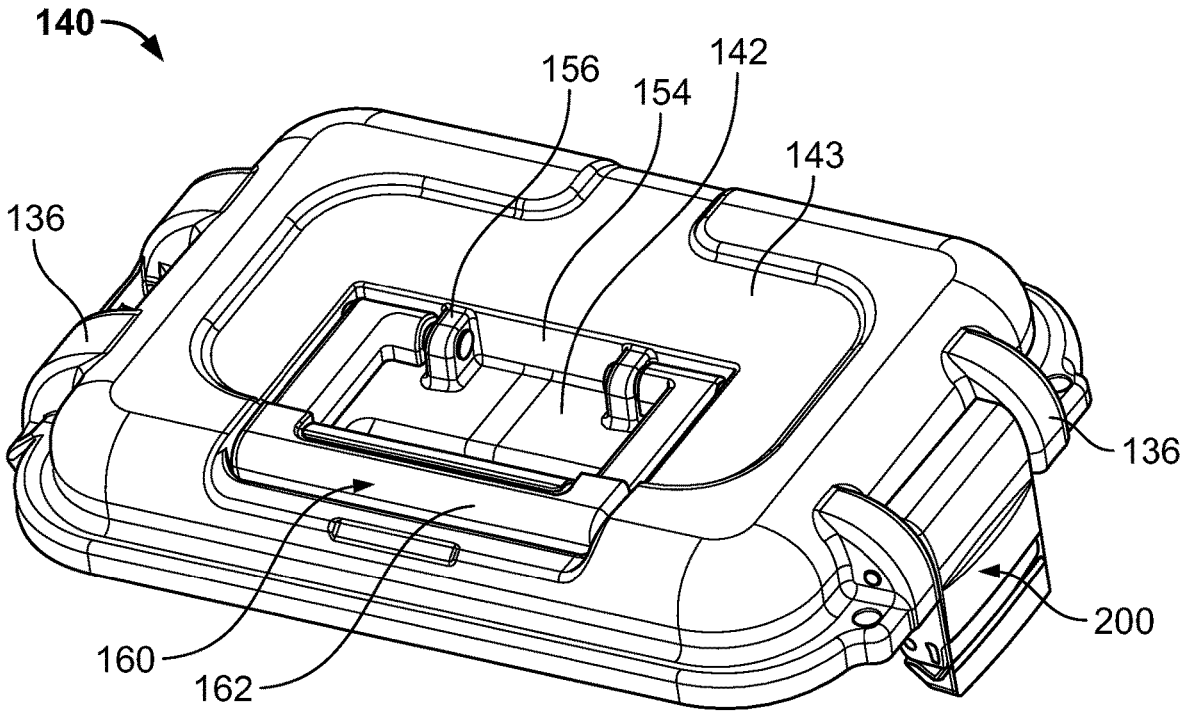
FIG. 3 illustrates a top perspective view of a lid of the container of FIG. 1 with a handle in a stowed position according to one or more aspects described herein.
Figure 4:
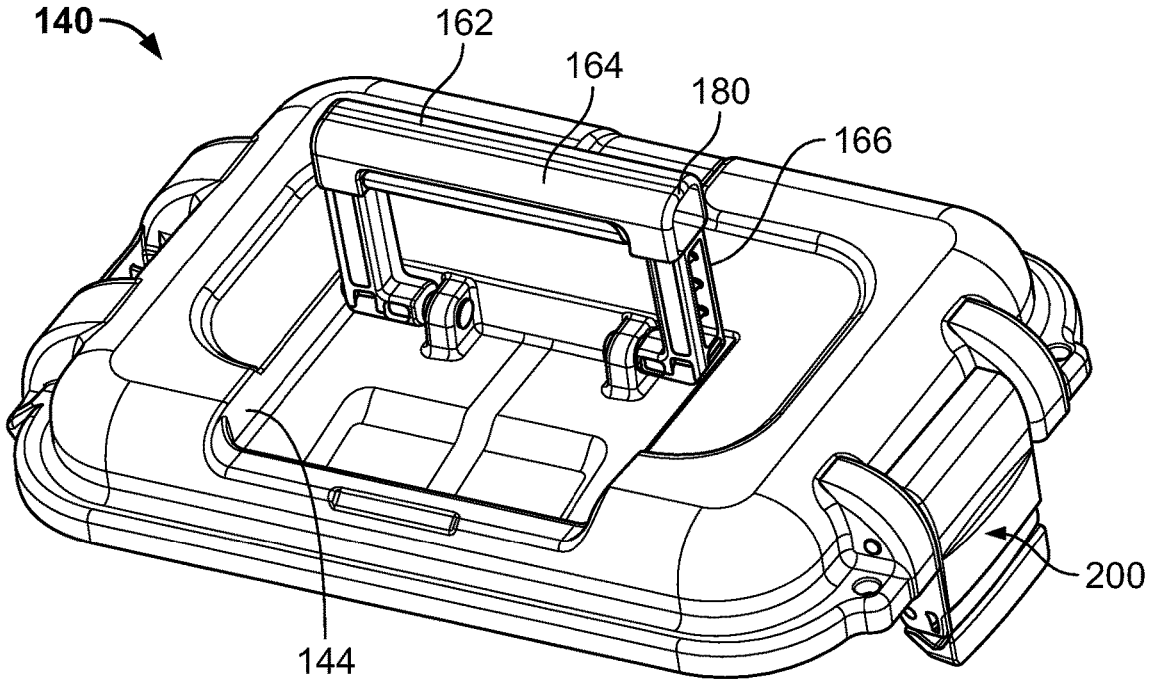
FIG. 4 illustrates a top perspective view of a lid of the container of FIG. 1 with a handle in a carry position according to one or more aspects described herein.
Figure 5:
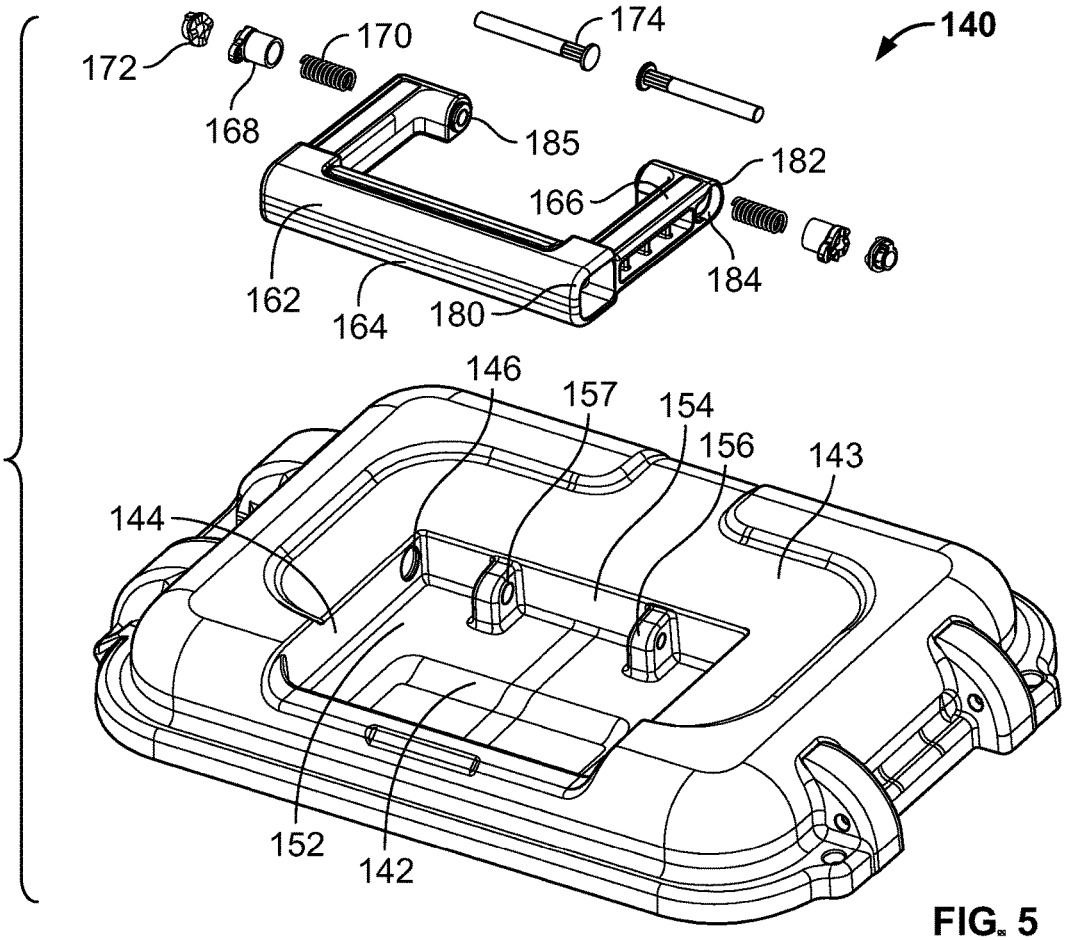
FIG. 5 illustrates an exploded top perspective view of a lid of the container of FIG. 1 according to one or more aspects described herein.
Figure 6:
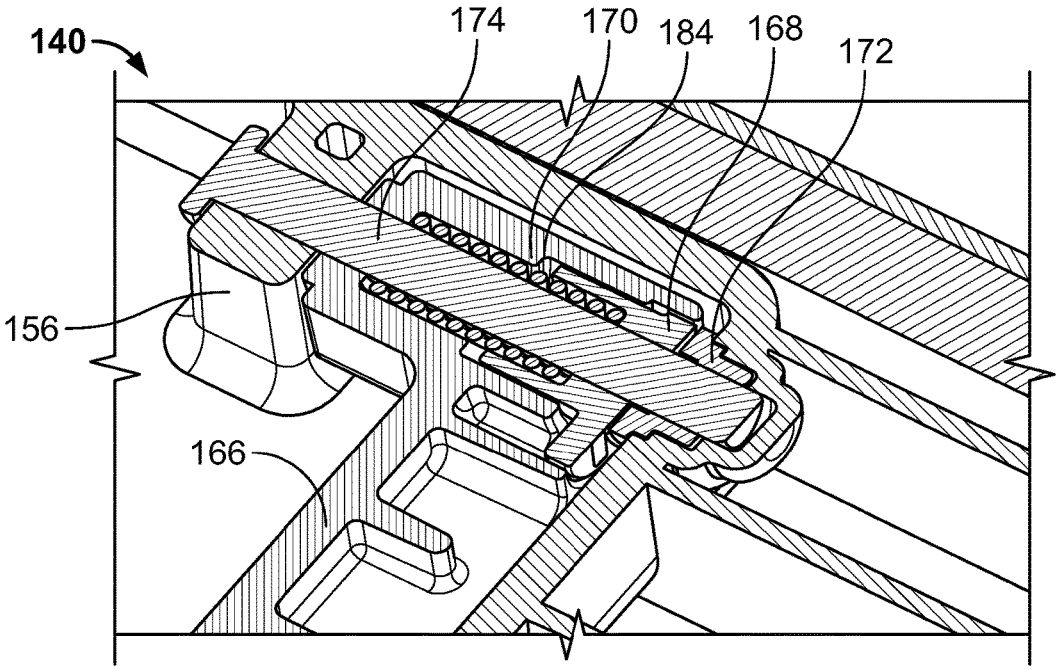
FIG. 6 illustrates a perspective cross-sectional view of a portion of the lid illustrating an attachment of the handle to the lid of the container of FIG. 1 according to one or more aspects described herein.

In some arrangements the container 100 may include a movable handle assembly 160 on the lid 140 that allows the handle 162 move be in a stowed position or a carry position and also to stay in either a stowed position or a carry position until acted upon by a user. The handle 162 may allow a user to easily lift and/or carry the container 100 using only a single hand to grasp the handle 162. The handle 162 may be pivotally attached to the lid 140 and located in a recessed cavity 142 that is located on an upper surface 143 of the lid 140. The handle 162 may have a stowed position, where the handle may be generally parallel to an upper surface 143 of the lid 140, as shown in FIG. 3 and a carry position, where the handle may be generally perpendicular to an upper surface 143 of the lid 140, as shown in FIG. 4. The handle assembly 160 may include components that allow the handle 162 to be maintained in the stowed position until acted upon by an upward or rotational force from a user that is greater than a threshold force to move the handle 162 from the stowed position to the carry or upright position. In addition, the handle assembly 160 allows the handle 162 to be maintained in the carry position until acted upon by a downward or rotational force from the user that is greater than a threshold force to move the handle from the carry position to the stowed position.

Figure 8:
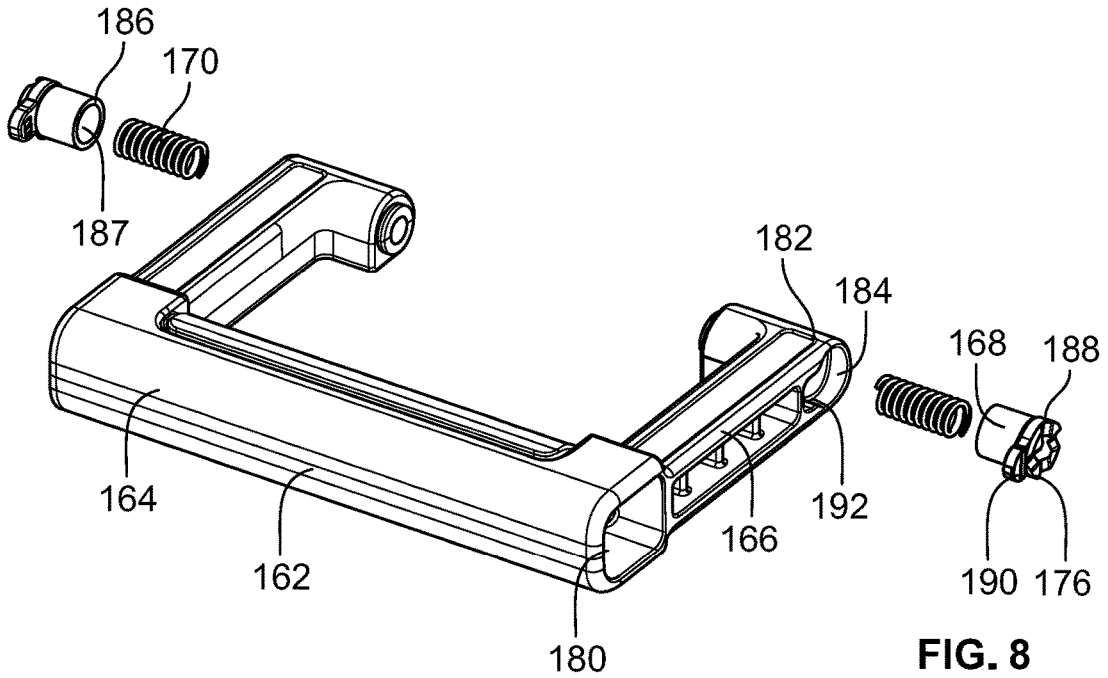
FIG. 8 illustrates an exploded perspective view of assembly of the handle assembly of the lid of the container of FIG. 1 according to one or more aspects described herein.
Figure 9:
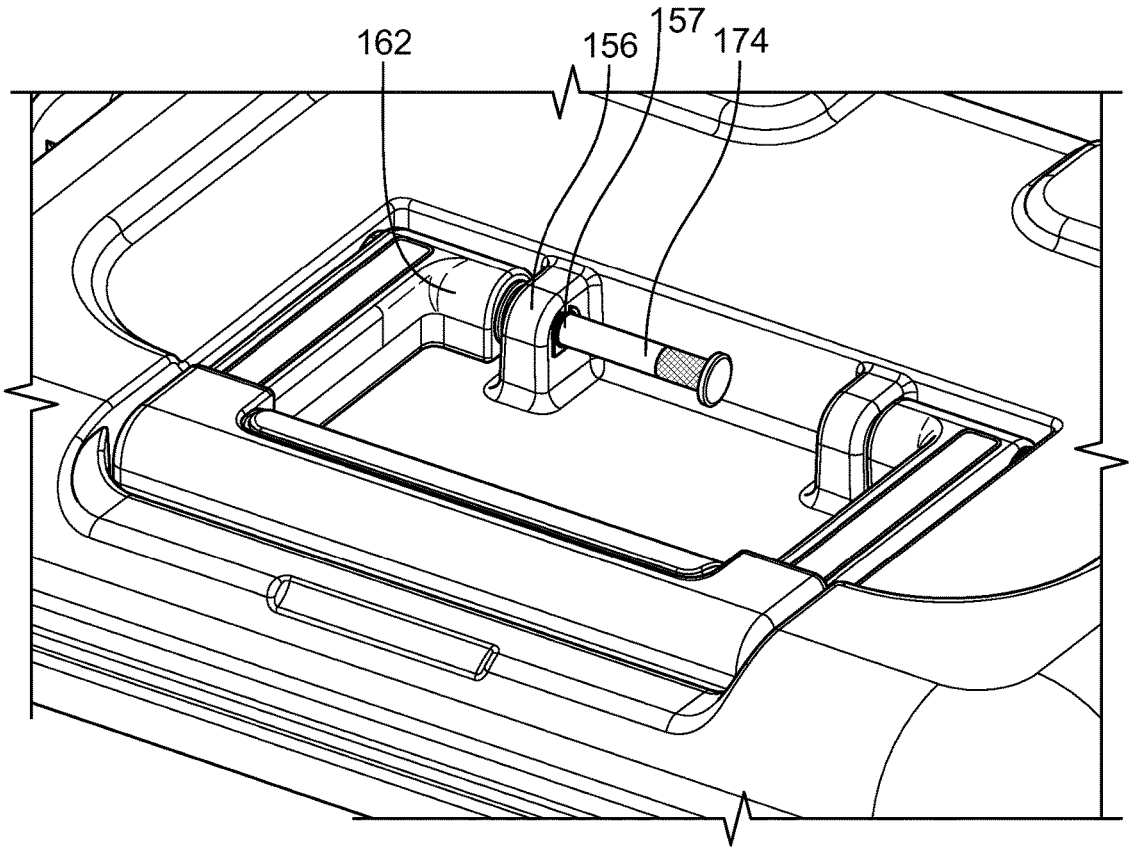
FIG. 9 illustrates an exploded perspective view of assembly of the handle assembly to the lid of the container of FIG. 1 according to one or more aspects described herein.
Figure 10:
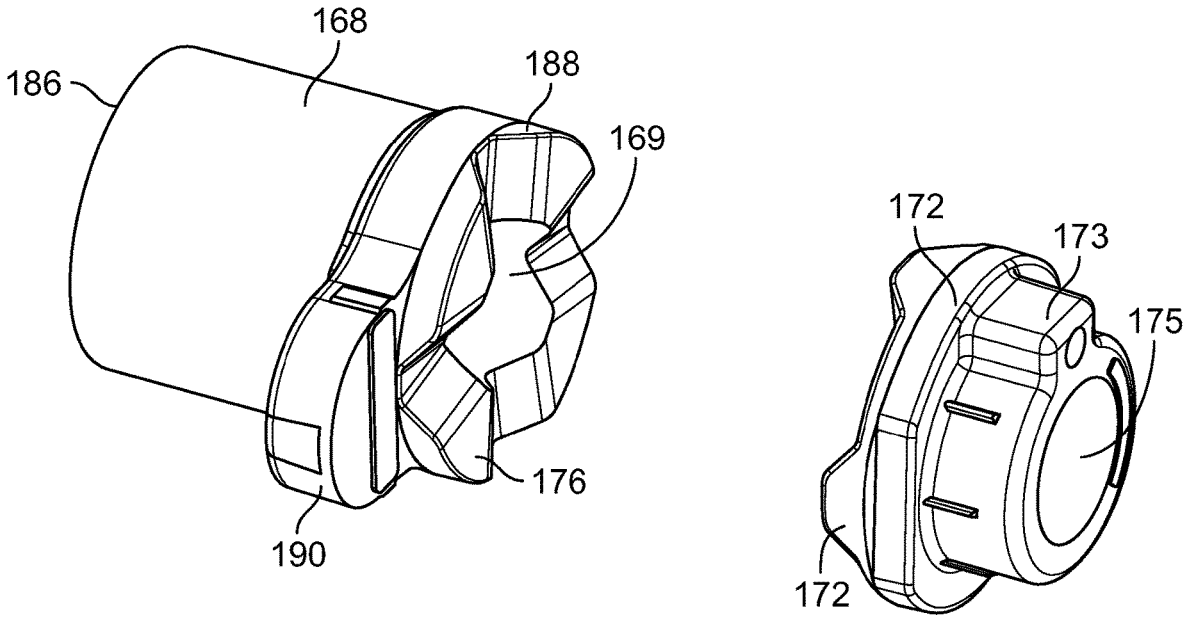
FIG. 10 illustrates an exploded perspective view of the plunger and the detent member of the lid of the container of FIG. 1 according to one or more aspects described herein.

As shown in FIGS. 5-10, the handle assembly 160 may include a handle 162, where the handle 162 comprises a grip portion 164 and a pair of legs 166, a plunger 168, a biasing member 170, a detent member 172, and a pin 174. The plunger 168 and the detent member 172 may engage each other to prevent any unwanted movement of the handle 162 as shown in FIG. 10. For example, the plunger 168 may include a plurality of engaging members 176 that engage a corresponding plurality of engaging members 178 on the detent member 172. The plurality of engaging members 176, 178 may comprise a plurality of protrusions, a plurality of recesses, and ramped surfaces between each protrusion and recess. In particular, each protrusion of the plurality of protrusions on the plunger 168 and the detent member 172 may be received in a corresponding recess of the plurality of recesses on the plunger 168 and the detent member 172. The ramped surfaces between each protrusion and each recess, allow the plunger 168 and detent member 172 to rotate with respect to each other as the engaging members contact and slide along each other when the handle 162 has an upward or downward force applied to it by a user that is greater than a threshold force. The protrusions and recesses may be arranged in an alternating pattern with each protrusion adjacent a recess with a ramped surface extending between a base surface of the recess to an upper surface of the protrusion. The interaction of the engaging members 176, 178 of the plunger 168 and the detent member 172 resists any movement of the handle 162 caused by any inadvertent movement or force applied to the container (e.g., such as the container being turned upside down or turned on its side). The biasing member 170 may provide a longitudinal force that keeps the engaging members 176, 178 engaged with each other to prevent any inadvertent movement of the plunger 168 relative to the detent member 172. The biasing member 170 may be a compression spring, or other member to apply a linear force to keep the plunger 168 engaged with the detent member 172 as known to one skilled in the art. In other words, unless a force is applied directly to the handle 162 greater than a threshold force, the handle 162 will stay in either a stowed or carry position. The threshold force may be determined by the force applied by the biasing member 170 as well as the depth of the recesses and the angle of the ramped surfaces on the engaging members 176, 178. The threshold force may be a force that is large enough such that the handle 162 will not move from a stowed position to a deployed position if the container 100 is turned upside down or even shaken when turned upside down. Similarly, the threshold force may a force that is large enough such that the handle 162 will not move from a deployed position to a stowed position if the container 100 is in an upright position and shaken from side to side. Alternatively, the plurality of engaging members 176, 178 may be corresponding sets of teeth that engage one another. As another alternate example, instead of engaging members 176, 178, the plunger 168 and the detent member 172 may include engaging faces that frictionally engage each other where biasing member 170 applies a force to create friction between these engaging faces create the threshold force.

Each leg 166 may have a fixed end 180 connected to each end of the grip portion 164 and a free end 182 opposite the fixed end 180. A pocket 184 may be located near the free end 182 of each leg 166 to receive the biasing member 170 and the plunger 168. In one example, the pocket 184 may be located on an outboard surface of each leg 166. Each plunger 168 may include a recess 187 at a first end 186 that receives the biasing member 170 and the plurality of engaging members 176 on the second end 188 opposite the first end 186. The plunger 168 may also include an anti-rotation member 190 that may contact a corresponding anti-rotation member 192 within the pocket 184. The anti-rotation members 190, 192 may be a boss and a corresponding recess where the recess or boss may be located on either the plunger 168 or within the pocket 184. The pocket 184 may also include an opening 185 that extends through a bottom surface of the pocket 184 through a remainder of the leg 166. In addition, the plunger 168 may include an opening 169 that extends through the plunger 168. In some examples, the pocket 184 that receives the plunger 168 and biasing member 170 may be arranged on an inboard surface of each leg 166. Optionally, the biasing member 170 may be integrally formed as part of the plunger 168 such that the plunger 168 and the biasing member 170 are made as a single component to provide the spring force to keep the plunger 168 engaged with the detent member 172.

The recessed cavity 142 of the lid 140 may be arranged to secure the handle 162. The recessed cavity 142 may include a pair of side surfaces 144 with each side surface 144 having a receiver 146 to secure the detent member 172. Each receiver 146 may also include an anti-rotation member (not shown) that may contact a corresponding anti-rotation member 173 located on the detent member 172. The anti-rotation members may be a boss and a corresponding recess where the recess or boss may be located on either the detent member 172 or within the receiver 146. The receiver 146 may be an opening in each side surface 144 and/or may include an insert placed in the receiver 146 to help secure the detent member 172. The recessed cavity 142 may also include an outward facing surface 152, a rear surface 154 and a pair of mounts 156 extending from the outward facing surface of the cavity 142. The pair of mounts 156 may be spaced inward from each of the side surfaces 144. The handle 162 may connect to the pair of mounts 156. In some examples, the pair of mounts 156 may also extend from and connect to the rear surface 154. Each mount 156 may include an opening 157, where the opening 157 of each mount 156 may be aligned along a longitudinal axis. Alternatively, the detent member 172 may be received in the opening 157 of each mount 156 to engage the plunger 168 in examples when the plunger 168 is located in a pocket 184 arranged on an inboard surface of each leg 166. In some examples, the recessed cavity 142 may include engaging members that are integrally formed in the side surfaces 144, such that these integrally formed engaging member interact with the engaging members 176 of the plunger 168 without the use of a separate detent member 172. As another option, the biasing member 170 may be located in the receiver 146 and/or adjacent to the detent member 172 to apply a force directly onto the detent member 172 to engage the detent member 172 with the plunger 168 instead of the biasing member 170 applying the force on the plunger 168.

Figure 7:
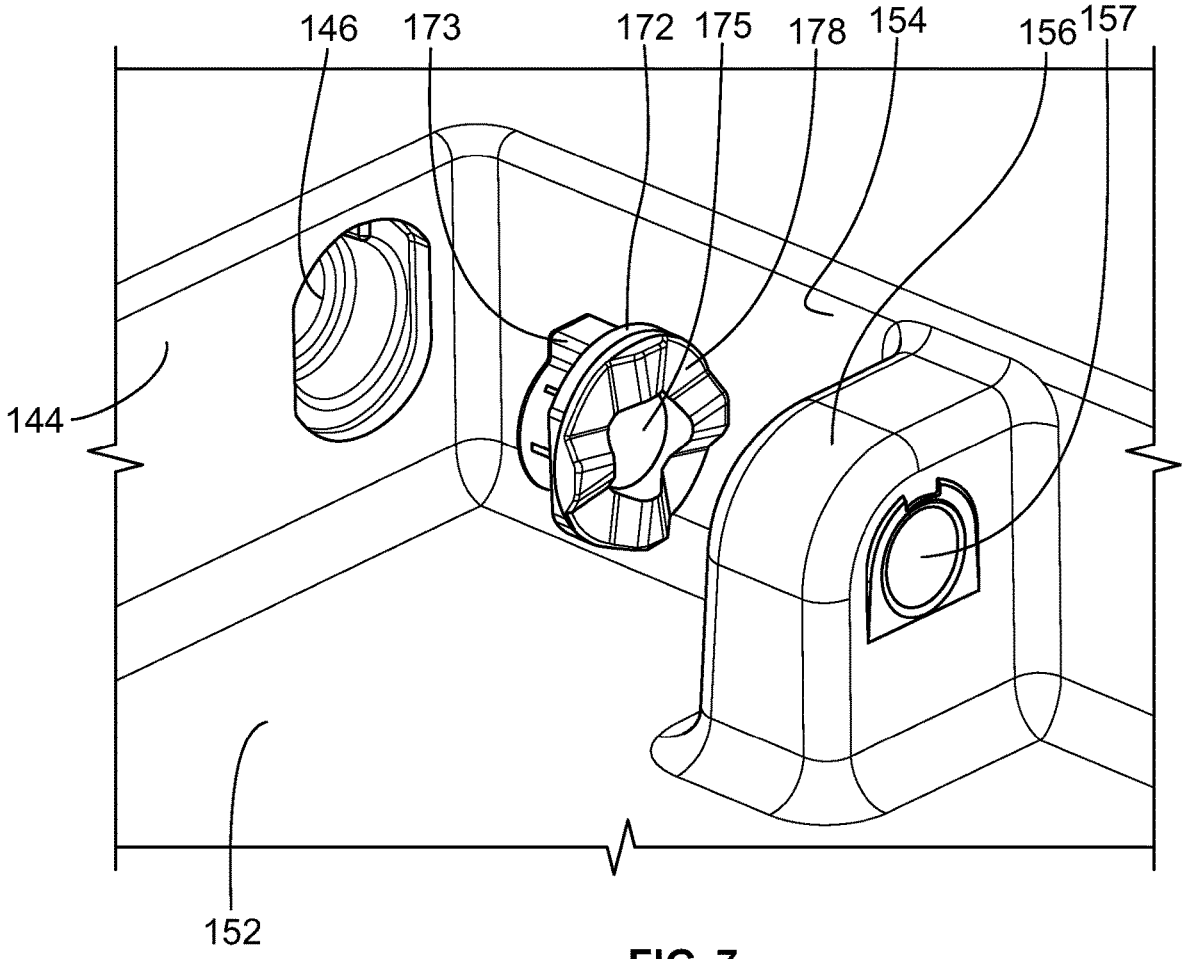
FIG. 7 illustrates an exploded perspective view of a portion of the lid during assembly of the handle to the lid of the container of FIG. 1 according to one or more aspects described herein.

FIGS. 7-9 illustrate the installation process of the handle assembly 160 to the lid 140. As shown in FIG. 7, each detent member 172 may be installed into the receiver 146 of the side surface 144, where the anti-rotation member of the receiver engages the anti-rotation member 173 of the detent member 172. In addition, the biasing member 170 and plunger 168 may be installed into the pocket 184 of each leg 166 with the biasing member 170 being at least partially received within the recess 187 of the plunger 168. The biasing member 170 may contact a bottom surface of the pocket 184. The anti-rotation member 190 of the plunger 168 may engage the anti-rotation member 192 of the pocket 184. Once the biasing member 170 and plunger 168 are installed into each leg 166 of the handle 162, the handle 162 may be positioned such that openings 157 of the mounts 156 are aligned with the openings 185 of each leg 166 and the opening 175 of the detent member 172. Next, a pin 174 is installed through the opening 157 of each mount 156, the opening 175 of the detent member 172, and the opening 185 of each leg 166 to rotatably connect the handle 162 to the lid 140. The pin 174 may be either permanently secured to the lid 140 with a friction fit with into the detent member 172 or within the receiver 146 of the side surface 144. In some examples, the pin 174 may be releasably connected to the lid 140 using a threaded connection or other connection method known to one skilled in the art.

In some arrangements, the container 100 may also include one or more latch assemblies 200. The latch assemblies 200 may have a locked position and an unlocked position and may be configured to lock the lid 140 when the lid 140 is in a closed configuration. The latch assemblies 200 may include one or more portions integrally formed with or otherwise attached to the container 100. As shown in FIGS. 2A-2B, the container 100 may include a latch keeper 210. The latch keeper 210 may extend from the sidewall structure 112 and may form a pocket within the container 100. The latch keeper pocket has a shape configured to receive a portion of the locking member 230 as will be discussed in more detail below. As will be discussed in greater detail below, the latch assemblies 200 may engage the latch keeper 210 to lock the lid 140 to the base portion 110 when the container 100 is in a closed configuration. The latch assembly 200 may be similar to the latch assemblies described in U.S. patent application Ser. No. 16/006,344 filed on Jun. 12, 2018 and U.S. patent application Ser. No. 17/123,746 filed on Dec. 16, 2020, which are both incorporated by reference in their entirety.

The container 100 may also include various features to improve the strength and/or functioning of the container 100. For example, the container may include various raised portions where certain portions of the base portion 110 and/or lid 140 extend further outward than other parts of the base portion 110 and/or lid 140. The container 100 may also include raised portions 136 surrounding the latch assembly 200 and the hinge 132. As shown in FIGS. 1 and 2, the raised portions 136 may exist on one or both of the base portion 110 or lid 140. The raised portions 136 may be raised equal to or greater than the height of the latch assembly 200 and hinge 132 respectively, such that the latch assembly 200 and/or hinge 132 do not extend outward beyond the raised portions 136 of the container 100. This may protect the latch assembly 200 and/or hinge 132 to reduce breakage of these components during use.

Figure 11A:
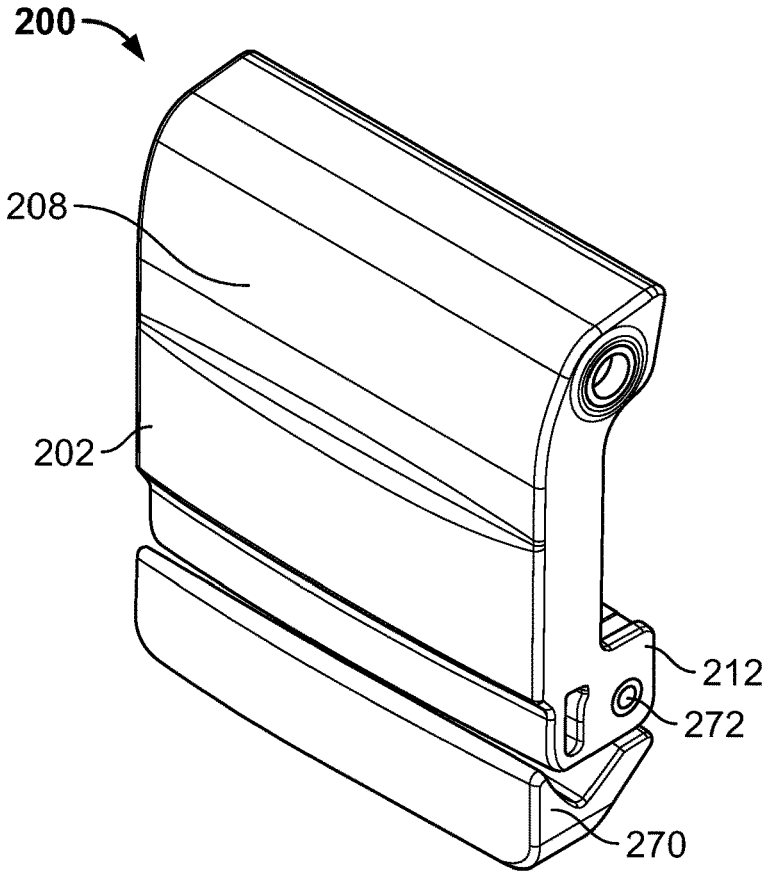
FIG. 11A illustrates a front perspective view of a latch assembly of the container of FIG. 1 according to one or more aspects described herein.
Figure 11B:
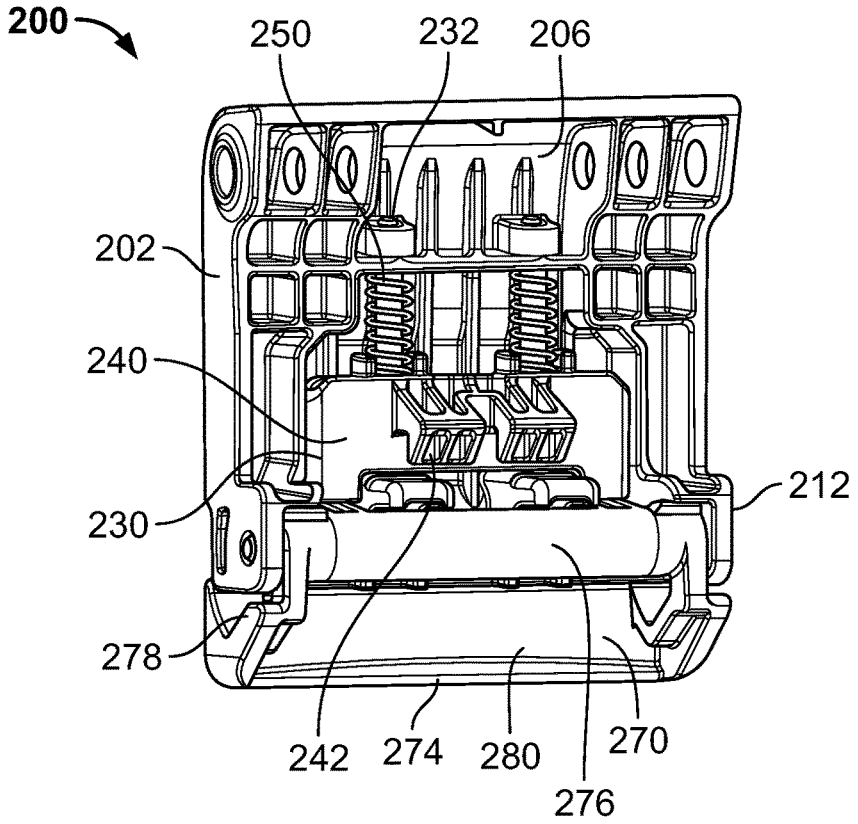
FIG. 11B illustrates a rear perspective view of the latch assembly of FIG. 11A according to one or more aspects described herein.

Referring now more specifically to the latch assembly 200, as best shown in FIGS. 11A and 11B. The latch assembly 200 may include multiple components including a latch body 202, a locking member 230, a biasing member 250, and an activating member 270. As discussed above, the latch assembly 200 may include a locked position and an unlocked position. The latch body 202 may be pivotally engaged with the lid 140. The latch body 202 may be pivotally engaged with the lid 140 using hinge 204, however, any suitable pivotal engagement may be used. The latch body 202 may include an inner surface 206 and an outer surface 208. The outer surface 208 may be curved and may generally follow the curve of the sidewall structure 112 of the container 100. The inner surface 206 may also be curved and may also include a number of different features. One exemplary feature that may be included on the latch body 202 may be one or more engagement lugs 212. The engagement lugs 212 may engage the base portion 110, or latch keeper 210, and may assist in compressing the lid 140 against the base portion 110 of the container 100.

The latch body 202 may also be engaged with the locking member 230. As shown in FIG. 11B, the locking member 230 may be slidably engaged with the latch body 202 such that the locking member 230 may move between an upward position and a downward position in a substantially linear path. The locking member 230 may be configured to lock the lid 140 in a closed configuration when the locking member 230 is in the downward position and unlock the lid 140 when the locking member 230 is in the upward position.

As shown primarily in FIG. 11B, the locking member 230 may be movably engaged with one or more guide members 232 such that the locking member 230 may slide up and down the guide members 232. In one embodiment, the locking member 230 may include apertures passing through the locking member 230 and through which the guide members 232 may also pass. The guide members 232 may be cylindrical rods but any suitable shape may be used that permits upward and downward movement of the locking member 230. As shown in FIG. 11B, the latch assembly 200 may also include at least one biasing member 250 engaged with the latch body 202 and the locking member 230. The biasing member 250 may be configured to bias the locking member 230 in a downward position. The biasing member 250 may be a compression spring as shown in FIG. 11B, but may in alternative embodiments be any suitable device for biasing the locking member 230 in the downward position.

The locking member 230 may include a base portion 240 and a hook portion 242 extending inwards from the base portion 240. When the latch assembly 200 is in the locked position, the hook portion 242 of the locking member 230 may engage the latch keeper 210. Additionally, when the latch assembly 200 is in the locked position the upper surface of the engagement lugs 212 may engage a lower surface of the latch keeper 210.

The latch body 202 may also be pivotally engaged with an activating member 270. The activating member 270 may also be engaged with the locking member 230 and may be configured to move the locking member 230 from the downward position to the upward position. The activating member 270 may be pivotally engaged to the latch body 202 by a hinge 272 extending through the latch body 202 and the activating member 270. The activating member 270 may include a grip portion 274, an activating barrel 276, and one or more arms 278 connecting the grip portion 274 and the activating barrel 276. The grip portion 274 may be spaced a distance from the sidewall structure 112 of the container 100. This distance may allow a user grip the back surface 280 of the grip portion 274 with their fingers placed between the sidewall structure 112 and the grip portion 274. The activating barrel 276 of the activating member 270 may engage the locking member 230. The activating barrel 276 may include at least one raised portion 282. To unlock the latch assembly 200, a user may pull the grip portion 274 of the activating member 270 forward causing the at least one raised portion 282 of the activating barrel 276 to rotate and lift up the locking member 230. This movement causes the latch assembly 200 to unlock and allows the lid 140 to be moved from the closed configuration to an open configuration.

Figures 12A, 12B, 12C:
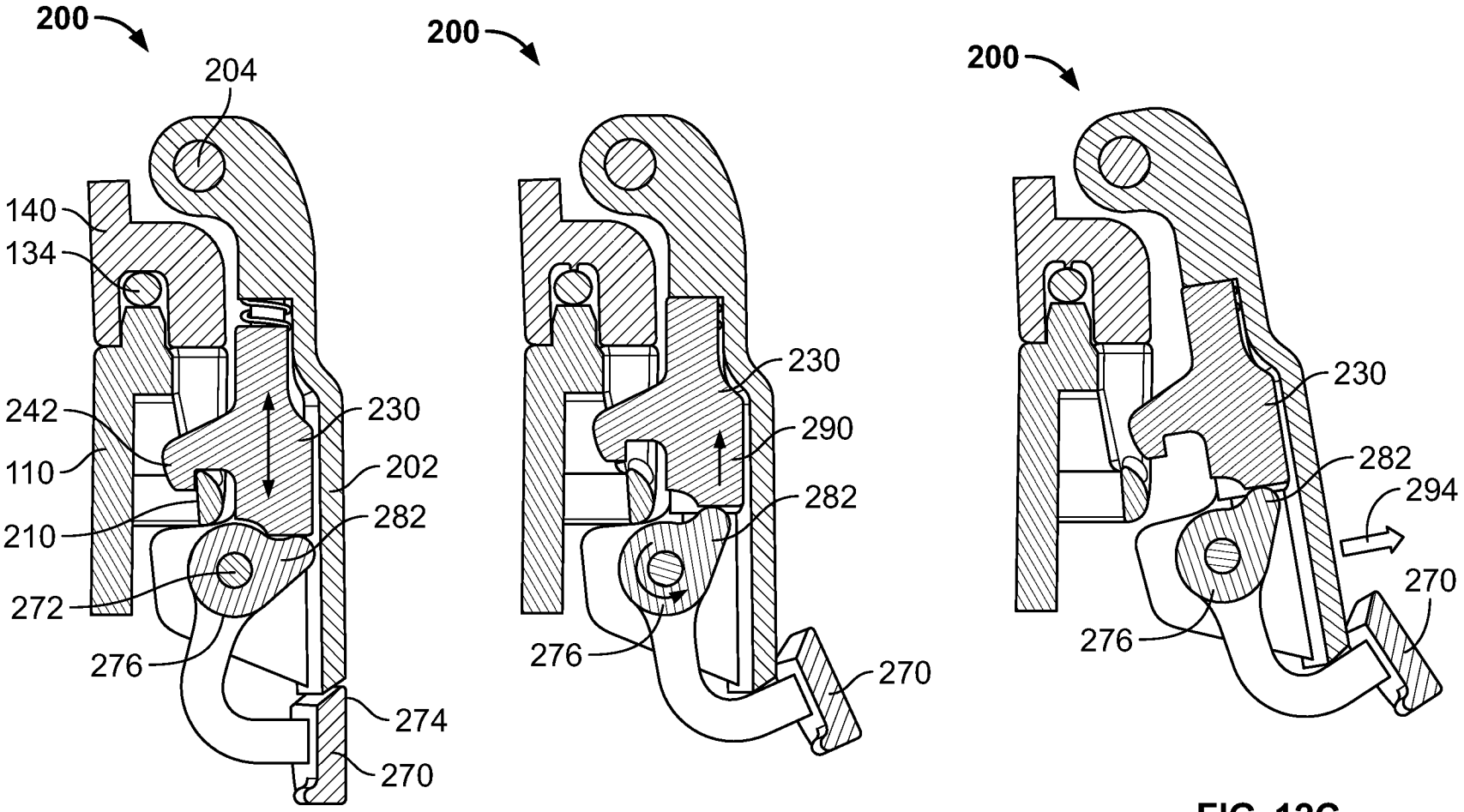
FIGS. 12A-12C illustrate cross-sectional views of the latch assembly of FIG. 11A moving from a locked position to an unlocked position according to one or more aspects described herein.

Referring now to FIGS. 12A-12C, a procedure for moving an embodiment of the latch assembly 200 from the locked position to an unlocked position is shown with side cross-sectional views of the latch assembly 200 and portions of the base portion 110 and lid 140. FIG. 12A depicts the latch assembly 200 in the locked position, FIG. 12B depicts the latch assembly 200 unlocking, and FIG. 12C depicts the latch assembly 200 in an unlocked position. As shown in FIG. 12A, in the locked position, the lower surface of hook portion 242 is engaged with the upper surface of the latch keeper 210; the inward facing surface of the hook portion 242 is engaged with the inner surface of the latch keeper 210; and the engagement lugs 212 are engaged with the lower surface of the latch keeper 210.

As shown in FIG. 12B, the latch assembly 200 may be moved to the unlocked position by rotating the activating member 270 as shown with arrow 290. This rotation may be accomplished by a user pulling forward on back surface 280. As shown in FIG. 12B, as the activating barrel 276 rotates, the at least one raised portion 282 engages and raises the locking member 230. As shown in FIG. 12C, the latch assembly 200 is in an unlocked position. As the locking member 230 raises above latch keeper 210, the latch assembly 200 becomes unlocked and the latch body 202, including the locking member 230 and the activating member 270, may rotate forward as indicated by arrow 294.

Figure 13C:
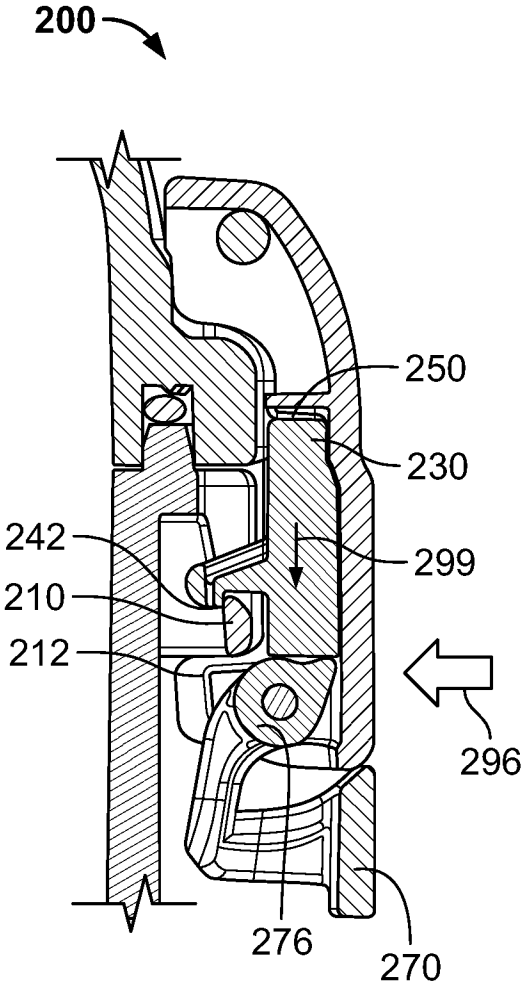
FIGS. 13A-13C illustrate cross-sectional views of the latch assembly of FIG. 11A moving from an unlocked position to a locked position according to one or more aspects described herein.
Figure 13B:
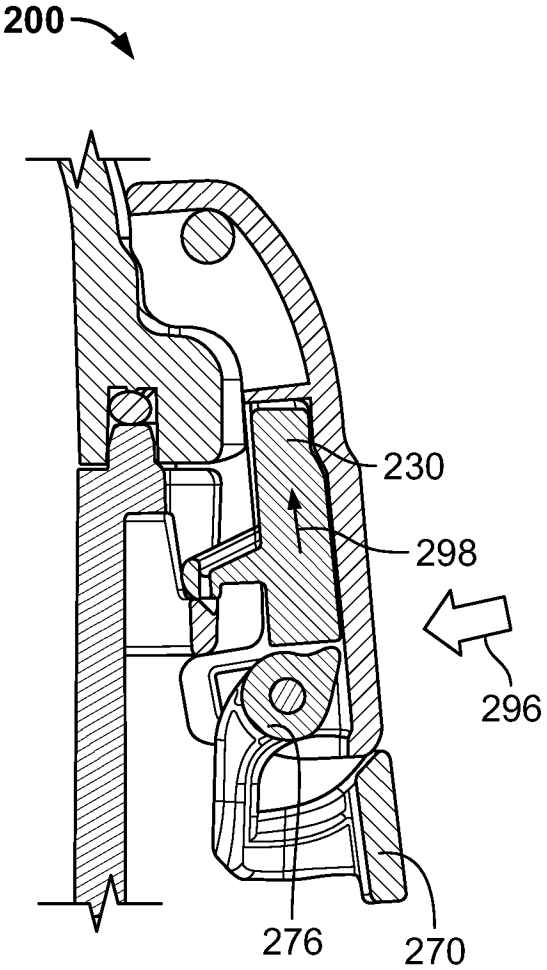
Figure 13A:
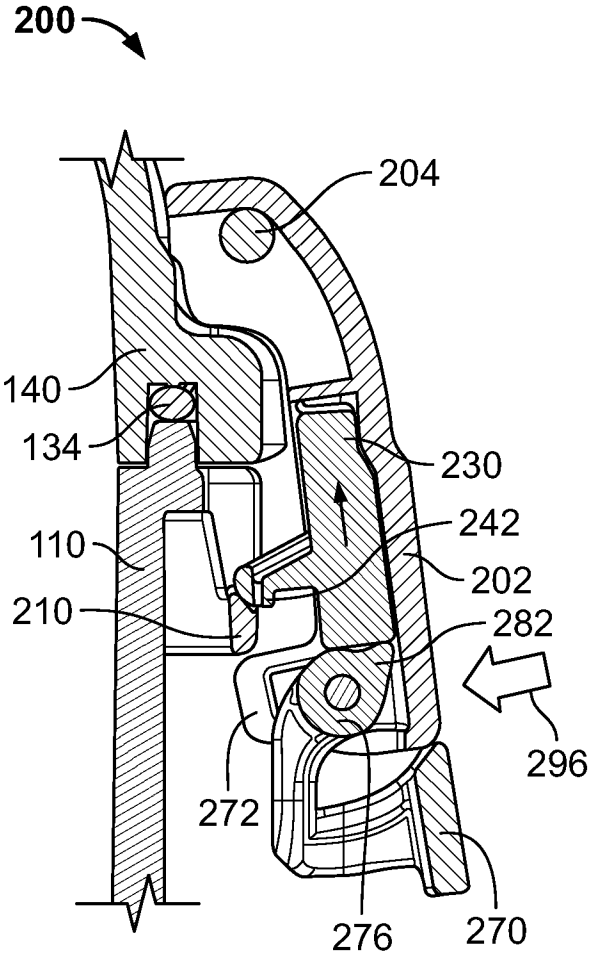

Referring now to FIGS. 13A-13C, a procedure for moving the latch assembly 200 from an unlocked position to locked position is shown with side cross-sectional views of the latch assembly 200 and portions of the base portion 110 and lid 140. FIG. 13A depicts the latch assembly 200 in an unlocked position, FIG. 12B depicts the latch assembly 200 locking, and FIG. 12C depicts the latch assembly 200 in locked position.

As shown in FIG. 13A, and as indicated by arrow 296, in one embodiment a user may return the latch assembly 200 to the locked position by pressing on latch body 202. As shown in FIG. 13B, as the latch body 202 is pressed inward, the locking member 230 may contact the latch keeper 210 which may cause the locking member 230 to raise upward as indicated by arrow 298. In other examples, in addition to pushing the latch body 202 inward, a user must also pull activating member 270 outward to move the latch assembly 200 to the locked position. In such an example, the latch assembly 200 may advantageously only be moved from the unlocked position to the locked position when the locking member 230 is moved in the upward position by the activating member 270. This may reduce the possibility of accidently locking the container 100.

As shown in FIG. 13C, once the hook portion 242 has moved behind the latch keeper 210, the biasing member 250 may push the locking member 230 in a downward direction. As shown in FIG. 13C, the latch assembly 200 is in the locked position and the lower surface of the hook portion 242 is engaged with the upper surface of the latch keeper 210; the inward facing surface of the hook portion 242 is engaged with the inner surface of the latch keeper 210; and the engagement lugs 212 are engaged with the lower surface of the latch keeper 210. When in a closed position, the latch assembly 200 may be positioned such that the lid 140 abuts the base portion 110 of the container 100, thus closing, securing, and/or sealing the container 100.

The latch assembly 200, including the latch body 202, locking member 230, and activating member 270, may each be separately formed and may be formed of materials such as plastic materials or another suitable material which can be formed or molded into the desired shape. The latch assembly 200 may be made of sufficient size, thickness and materials of construction to withstand repeated cycles of stress as the latch is engage/disengaged with the latch keeper 210 over time. The containers described herein include various features that ensure easy and efficient manufacture of the containers, while providing durability and wear resistance.

In order to avoid any inadvertent unlocking of the latch assembly 200, the container 100 or the latch assembly 200 may include various different concepts to prevent an accidental unlocking of the latch assembly 200. These concepts are illustrated in FIGS. 14A-18C.

Figure 14A:
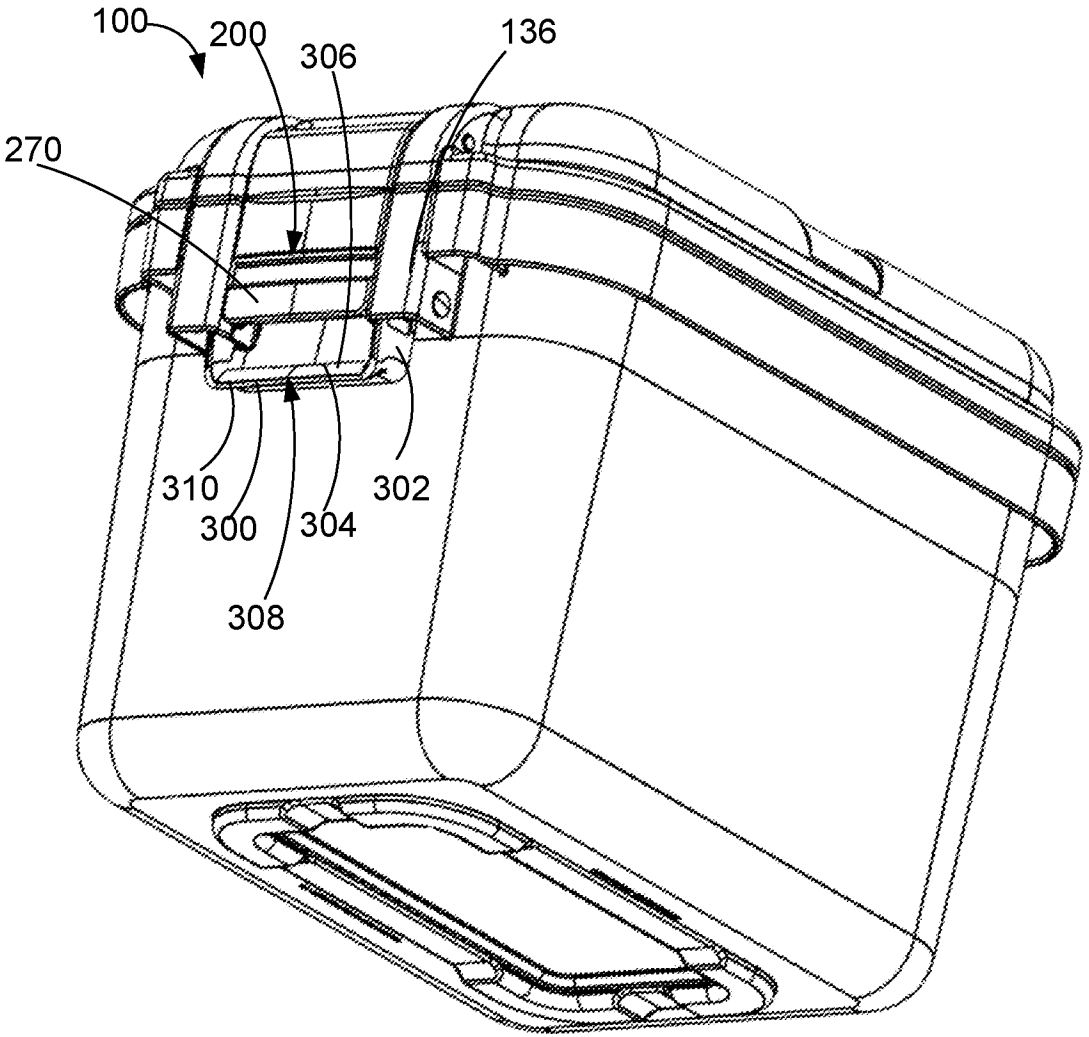
FIG. 14A illustrates a front perspective view of an alternate container of FIG. 1 with a latch guard according to one or more aspects described herein.
Figure 14C:
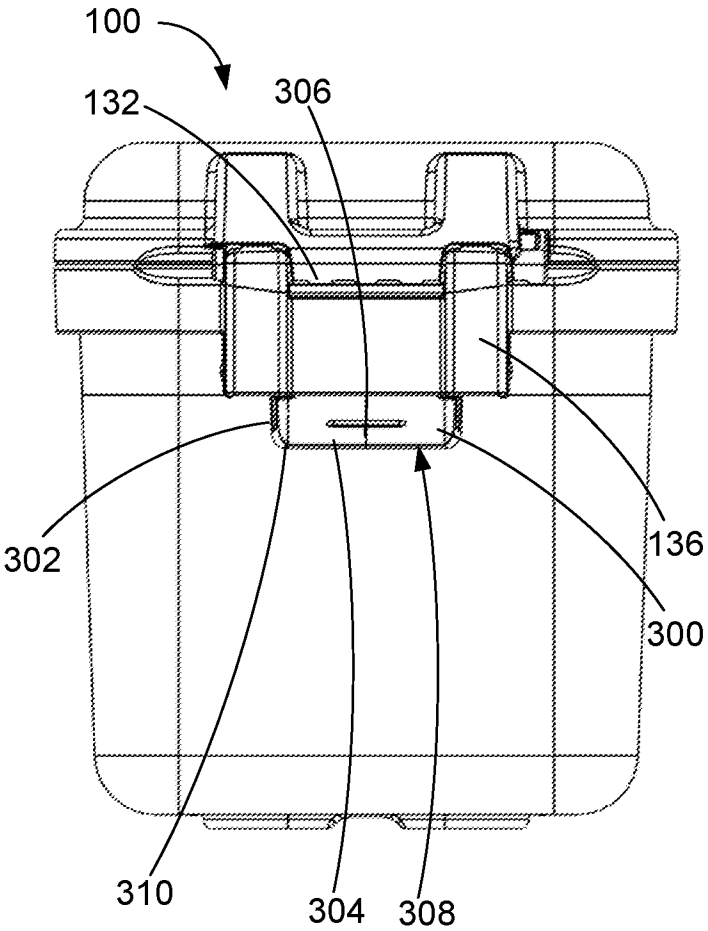
FIG. 14C illustrates a rear view of the container of FIG. 14A according to one or more aspects described herein.
Figure 14B:
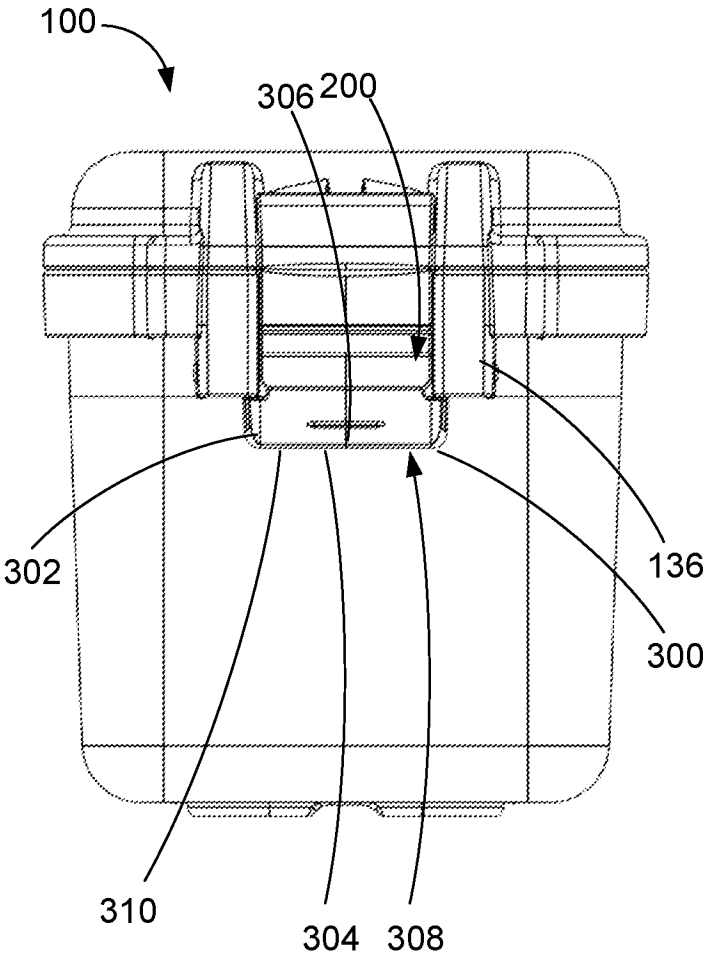
FIG. 14B illustrates a front view the container of FIG. 14A with a latch guard according to one or more aspects described herein.

FIGS. 14A-14C illustrate a latch guard 300 that located below latch assembly 200. The latch guard 300 may fixedly connect to the raised portions 136 that are positioned on either or both sides of the latch assembly 200 as shown in FIGS. 14A-14B. The latch guard 300 may comprise a pair of arms 302 and a cross-member 304 connected between the pair of arms 302. The arms 302 may be connected to the container 100 within a recess located within the raised portions 136 or attached to a surface of the raised portions 136.

The cross-member 304 may have an upper surface 306 and a lower surface 308. The upper surface 306 being spaced a predetermined distance below the activating member 270 of the latch assembly 200. This spacing allows for a user to reach their hand between the activating member 270 and the upper surface 306 and still use their hand to pull on the activating member 270 to unlock the latch assembly 200 in the manner described above. In addition, the cross-member 304 may act as a fixed handle to allow a user to lift the container 100 without the risk of unlocking the latch assembly 200. The upper surface 306 may have a ramped or curved shape to allow a larger spacing from the latch assembly 200 near a front edge 310 than at a rear edge of the cross-member. Additionally, the lower surface 308 may have a concave shape. The concave lower surface 308 may also include a plurality of ribs to help to make it easier for a user to grip. The cross-member 304 may have a width that is greater than a width of the latch assembly 200, where the width is defined as the horizontal distance along the length of the cross-member 304. In addition, container 100 may have a second latch guard 300 that is arranged below the hinge 132 on the side of the container 100 opposite the latch assembly 200 as shown in FIG. 14C. Similarly, the latch guard 300 underneath the hinge 132 may be connected to raised portions 136 on either side of the hinge 132 and spaced a predetermined distance below the hinge 132. By arranging a latch guard 300 on opposing sides, a user may easily lift the container 100 without risk of tilting the container 100 or accidentally unlocking the container 100.

Figure 15B:
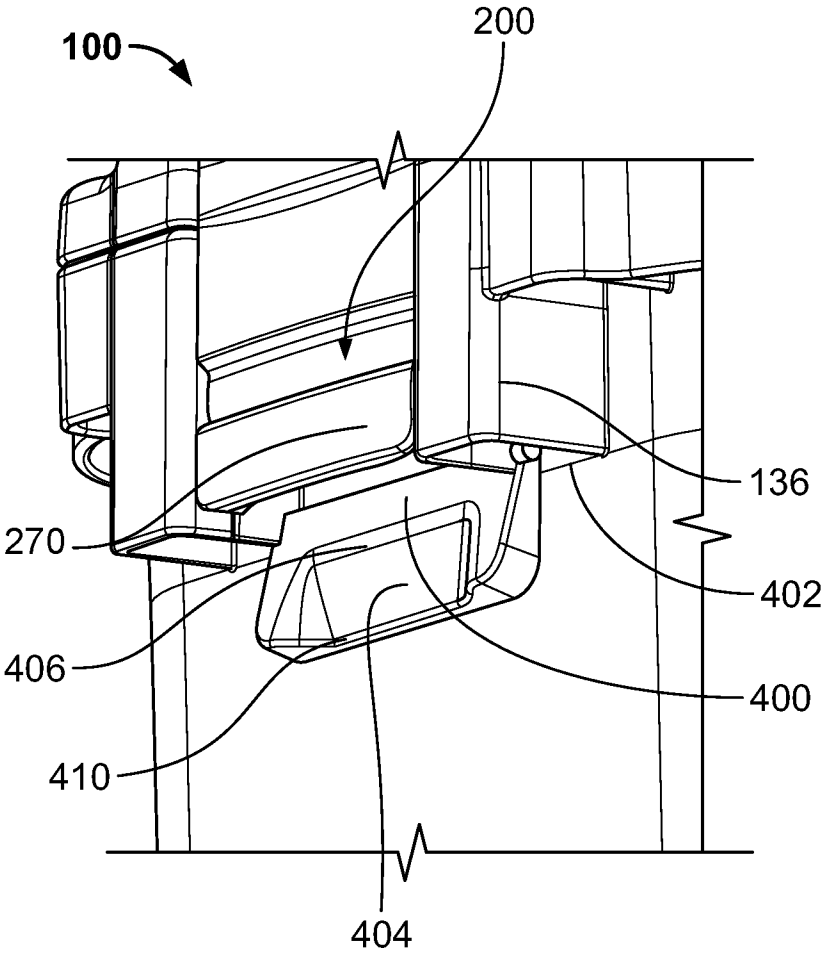
FIG. 15B illustrates a rear perspective view of the container of FIG. 15A with a latch guard in an accessible position according to one or more aspects described herein.
Figure 15A:
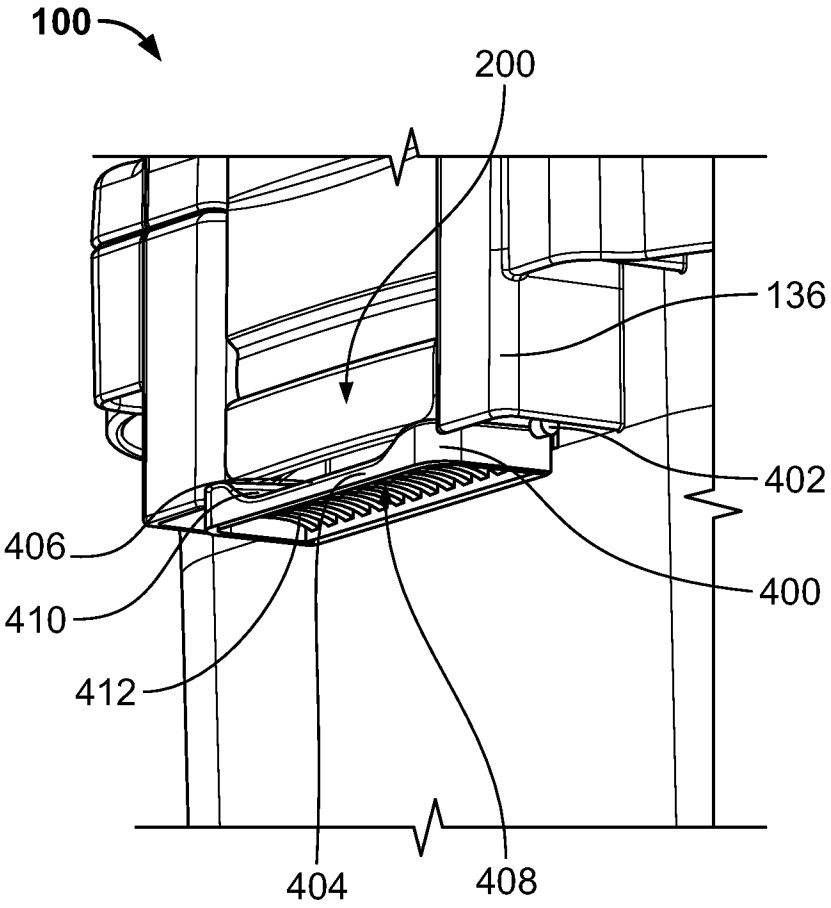
FIG. 15A illustrates a front perspective view of an alternate container of FIG. 1 with a latch guard in a restrictive position according to one or more aspects described herein.

FIGS. 15A-15B illustrate latch guard 400, which is another device that can protect the latch assembly 200 from being inadvertently unlocked. Latch guard 400 may be located below latch assembly 200. The latch guard 400 may pivotally connect to the raised portions 136 that are positioned on either or both sides of the latch assembly 200. The latch guard 400 may comprise a pair of axles 402 and a cross-member 404 connected between the pair of axles 402. The axles 402 may be aligned along an axis such that the latch guard 400 may rotate around the axis. The axles 402 may be connected to the container 100 at a lower region of the raised portions 136 where the axis is positioned below the lowest surface of the latch assembly 200. The latch guard 400 may have a restrictive position that prevents a user from engaging the activating member 270 of the latch assembly 200 as shown in FIG. 15A and an accessible position that allows a user to engage the activating member 270 and unlock the latch assembly 200 as shown in FIG. 15B where the latch guard 400 is rotated downward away from the latch assembly 200. A biasing member (not shown) may apply a force to the latch guard 400 to bias the latch guard 400 in the restrictive position to prevent the any accidental unlocking of the latch assembly 200.

The cross-member 404 may have an upper surface 406 and a lower surface 410. The upper surface 406 may include a ramped portion that slopes downward toward the front edge 408 to provide a larger spacing from the latch assembly 200 near a front edge 408 than at a rear edge of the cross-member 404. The larger spacing provide additional clearance for a user to grasp and activate the latch assembly 200. Additionally, the lower surface 410 may have a concave shape. The concave lower surface 410 may also include a plurality of ribs 412 to help to make it easier for a user to grip. The cross-member 404 may have a width that is greater than a width of the latch assembly 200, where the width is defined as the horizontal distance along the length of the cross-member 404. In some examples, container 100 may have a second latch guard 400 that is arranged below the hinge 132 on the side of the container 100 opposite the latch assembly 200. Similarly, the latch guard 400 underneath the hinge 132 may be connected to raised portions 136 on either side of the hinge 132. The latch guard 400 on the side with the hinge 132 may be rotatably connected or may be fixedly connected where it cannot rotate. By arranging a latch guard 400 on opposing sides, a user may easily lift the container 100 without risk of tilting the container 100 or accidentally unlocking the container 100.

Latch guards 300, 400 may be formed from a polymeric or metallic material. Additionally, latch guards 300, 400 may be formed by various forming methods. For example, metal components, may be formed by forging, molding, casting, stamping, machining, and/or other known techniques. Additionally, polymer components may be manufactured by polymer processing techniques, such as various molding, (e.g. injection molding) and casting techniques and/or other known techniques.

Figure 16C:
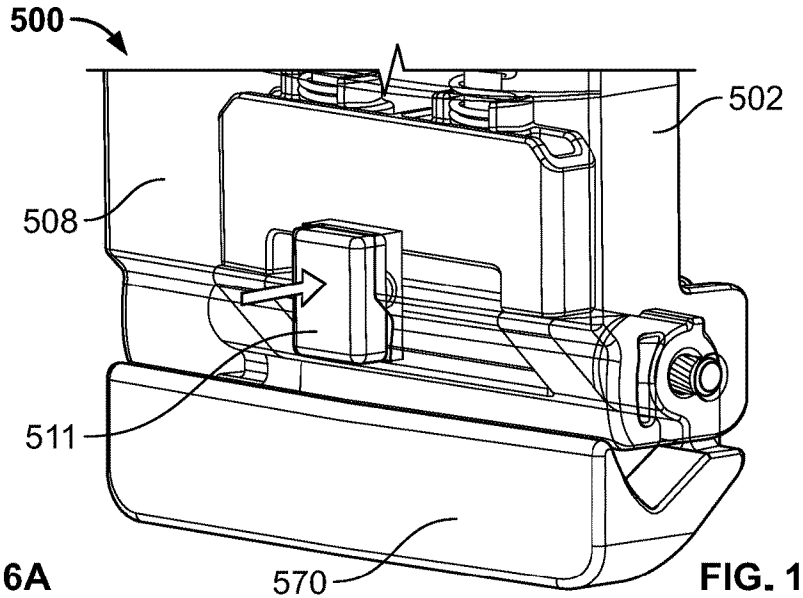
FIG. 16C illustrates a perspective view of a portion of the latch assembly of FIG. 16A in an accessible position according to one or more aspects described herein.
Figure 16A:
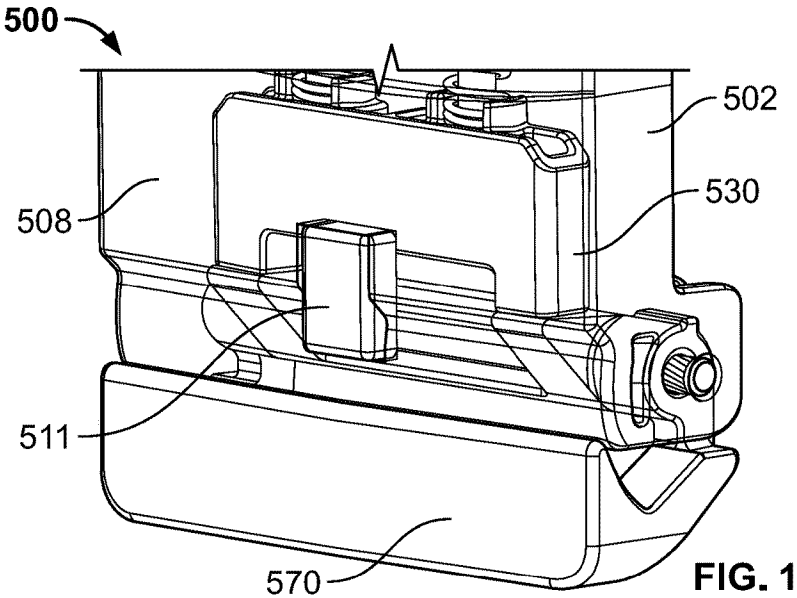
FIG. 16A illustrates a perspective view of an alternate latch assembly for the container of FIG. 1 in a restrictive position according to one or more aspects described herein.

As an alternative to a latch guard discussed above, FIGS. 16A-16D illustrate a modified latch assembly 500. For the example latch assembly 500 of FIGS. 16A-16D, the features are referred to using similar reference numerals under the "5xx" series of reference numerals, rather than "2xx" as used in the latch assembly 200 of the container 100 of FIGS. 1-15B. Accordingly, certain features of the latch assembly 500 that were already described above with respect to latch assembly 200 of the container 100 of FIGS. 1-15B may be described in lesser detail, or may not be described at all. Latch assembly 500 may include a locking button 511 arranged on the outer surface 508 of the latch body 502, as shown in FIG. 16A, as well as all of the other components of latch assembly 200. The locking button 511 may have a locked state that prevents the locking member 530 from moving relative to the latch body 502, which prevents the latch assembly 500 from moving to an unlocked position, and an unlocked state when the locking button 511 is depressed, which allows the locking member 530 to move relative to the latch body 502 and allows the latch assembly 500 to move to an unlocked position.

Figure 16D:
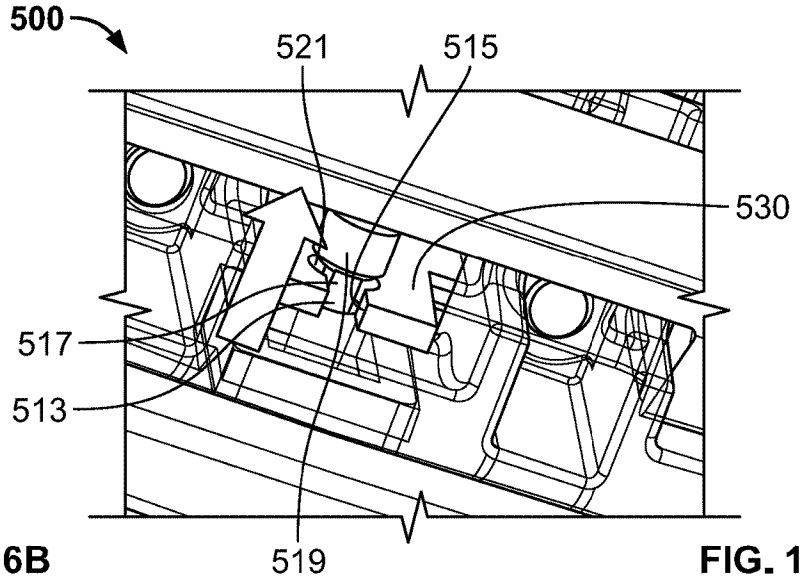
FIG. 16D illustrates a perspective view of a portion of the latch assembly of FIG. 16A in an accessible position according to one or more aspects described herein.
Figure 16B:
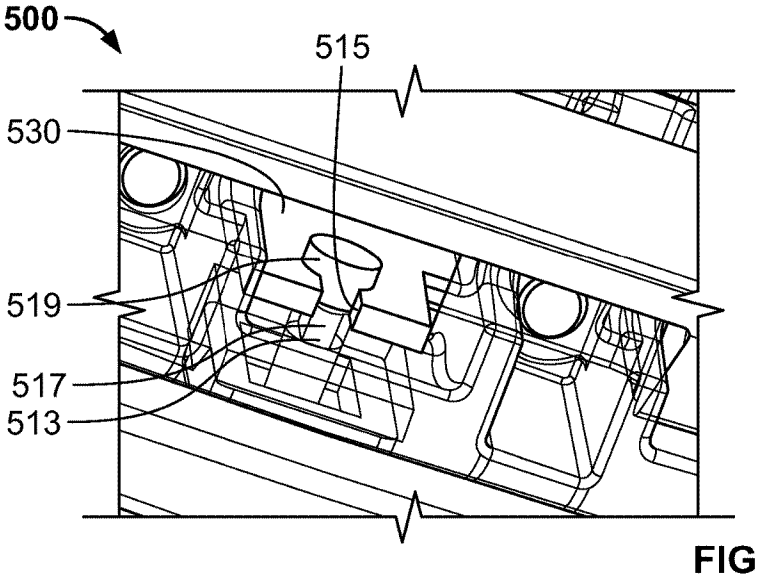
FIG. 16B illustrates a perspective view of a portion of the latch assembly of FIG. 16A in a restrictive position according to one or more aspects described herein.

The locking button 511 may be connected to a key member 513 that engages the locking member 530 of the latch assembly 500. The locking button 511 may connect to a key member 513 that extends inward from the locking button 511 through the latch body 502 and toward the locking member 530. The key member 513 may be received in a slot 515 of the locking member 530. The key member 513 may have generally elongated body member 517 and an enlarged end portion 519. The end portion 519 may be received in a recess 521 that is located on an inboard side of the locking member 530 and intersects the slot 515. In some examples, the elongated body member 517 and end portion 519 may have a cylindrical shape, or may have geometrical cross-sectional shape, such as circular, square, hexagonal or other geometric shape. A biasing member (not shown) may apply a force to the locking button 511 to bias the locking button 511 in the locked state to prevent the any accidental unlocking of the latch assembly 500. When the locking button 511 is in a locked state, the end portion 519 is secured within the recess 521 to prevent the locking member 530 from moving relative to the latch body 502, as shown in FIG. 16B, which in turn prevents the latch assembly 500 from inadvertently moving to an unlocked position. To move the latch assembly 500 from a locked position to an unlocked position, a user must depress the locking button 511, as shown in FIG. 16C, which moves the enlarged end portion 519 from the recess 521. Once the enlarged end portion 519 is free from the recess 521, the elongated body member 517 is free to slidably move within the slot 515, as shown in FIG. 16D, which also allows the locking member 530 to be moved from a locked position to an unlocked position when the user pulls the activating member 570. Thus, to move the latch assembly 500 from a locked position to an unlocked position, a user must engage both the locking button 511 and the activating member 570 (i.e., a user must both depress the locking button 511 and pull the activating member 570). This dual movement helps to prevent the latch assembly 500 from being accidentally moved to an unlocked position.

Figure 17A:
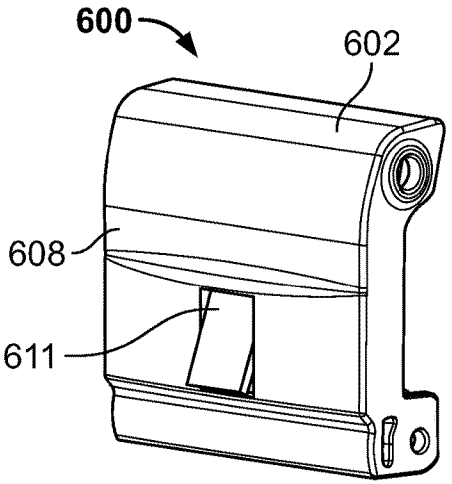
FIG. 17A illustrates a perspective view of an alternate latch assembly for the container of FIG. 1 in a restrictive position according to one or more aspects described herein.
Figure 17B:
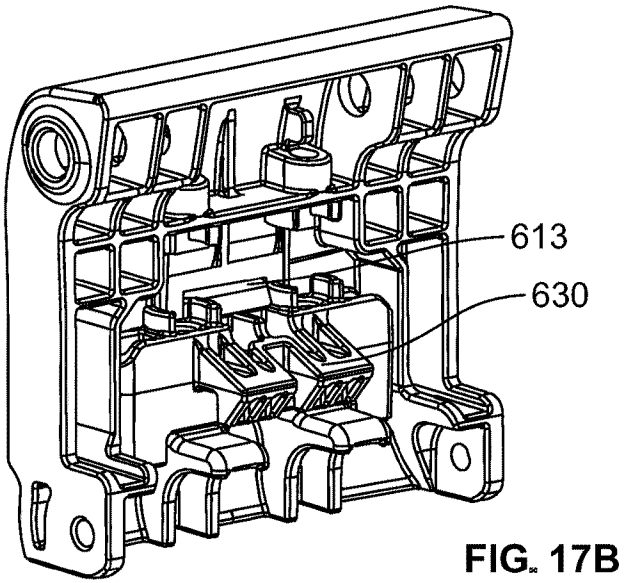
FIG. 17B illustrates a perspective view of a portion of the latch assembly of FIG. 17A in a restrictive position according to one or more aspects described herein.
Figure 17C:
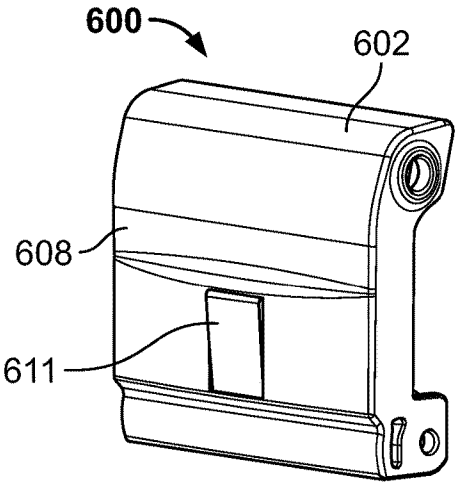
FIG. 17C illustrates a perspective view of a portion of the latch assembly of FIG. 17A in an accessible position according to one or more aspects described herein.

As another alternative to a latch guard discussed above, FIGS. 17A-17D illustrate a modified latch assembly 600. For the example latch assembly 600 of FIGS. 17A-17D, the features are referred to using similar reference numerals under the "6xx" series of reference numerals, rather than "2xx" as used in the latch assembly 200 of the container 100 of FIGS. 1-15B. Accordingly, certain features of the latch assembly 600 that were already described above with respect to latch assembly 200 of the container 100 of FIGS. 1-15B may be described in lesser detail, or may not be described at all. Latch assembly 600 may include a locking button 611 arranged on the outer surface 608 of the latch body 602, as shown in FIG. 17A, as well as all of the other components of latch assembly 200. FIGS. 17A-17D illustrate latch assembly 600 with some components removed to illustrate the interaction between the locking member 630 and the locking button 611. The locking button 611 may have a locked state that prevents the locking member 630 from moving relative to the latch body 602, which prevents the latch assembly 600 from moving to an unlocked position, and an unlocked state, which allows the locking member 630 to move relative to the latch body 602 and allows the latch assembly 600 to move to an unlocked position. The locking button 611 may be pivotally connected to the latch body 602, such that when the one side of the locking button 611 is in a locked state, a portion of the locking button 611 is below the outer surface 608 and a portion of the locking button 611 is above the outer surface 608. FIG. 17A illustrates the locking button 611 in a locked state, where the upper portion of the locking button 611 is below the outer surface 608, and the lower portion of the locking button 611 is above the outer surface 608. FIG. 17C illustrates the locking button 611 in an unlocked state, where the upper portion of the locking button 611 and the lower portion of the locking button 611 are substantially aligned with the outer surface 608 of the latch body 602. While the illustrated example shows the locking button 611 pivotally attached to the latch body 602 in a central location with a horizontally oriented axis, the location and orientation of the pivot for the locking button 611 may be located in different locations and orientations without departing from this invention.

Figure 17D:
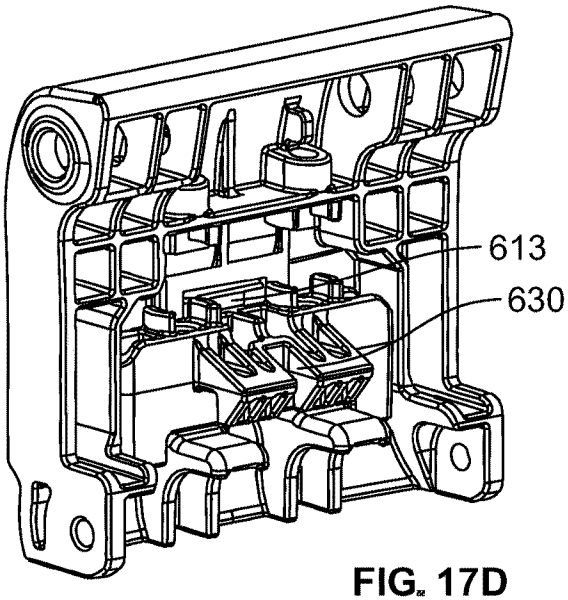
FIG. 17D illustrates a perspective view of a portion of the latch assembly of FIG. 17A in an accessible position according to one or more aspects described herein.

The locking button 611 may have an extension 613 that protrudes inward (i.e. away from the outer surface 608 of the latch body 602) from the locking button 611. The extension 613 may extend from the upper portion of the locking button 611. In some examples, the extension 613 may form a hook shape to better engage the locking member 630. When the locking button 611 is in a locked state, the extension 613 may contact an upper surface of the locking member 630 to prevent the locking member 630 from moving relative to the latch body 602 as shown in FIG. 17B. A biasing member (not shown) may apply a force to the locking button 611 to bias the locking button 611 in the locked state to prevent the any accidental unlocking of the latch assembly 600. By preventing the movement of the locking member 630 relative to the latch body 602, the latch assembly 600 is unable to be accidentally unlocked even if the activating member 670 is pulled. When the locking button 611 is moved to an unlocked state, the extension 613 is no longer in contact with the locking member 630, as shown in FIG. 17D, which allows the locking member 630 to slidably move relative to the latch body 602. By allowing the movement of the locking member 630 relative to the latch body 602, the latch assembly 600 is able to move to an unlocked position when a user pulls the activating member 670. Thus, to move the latch assembly 600 from a locked position to an unlocked position, a user must depress a lower portion of the locking button 611, as shown in FIG. 17C, which moves the extension 613 from contacting the locking member 630. Once the extension 613 is free from contact with the locking member 630, as shown in FIG. 17D, the locking member 630 is able to slidably move along the latch body 602 and allow the latch assembly 600 to be moved from a locked position to an unlocked position when the user pulls the activating member 670. Thus, to move the latch assembly 600 from a locked position to an unlocked position, a user must both depress a portion of the locking button 611 and pull the activating member 670. This dual movement helps to prevent the latch assembly 600 from being accidentally moved to an unlocked position.

Figure 18C:
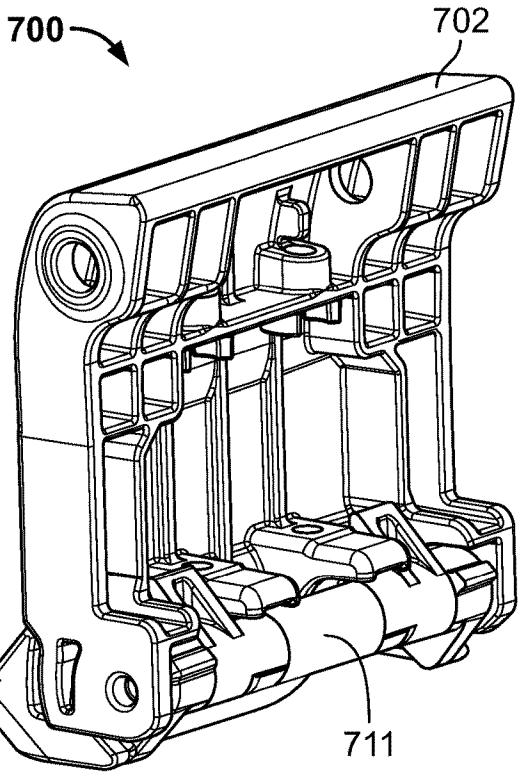
FIG. 18C illustrates a perspective view of a portion of the latch assembly of FIG. 18A in an accessible position according to one or more aspects described herein.
Figure 18B:
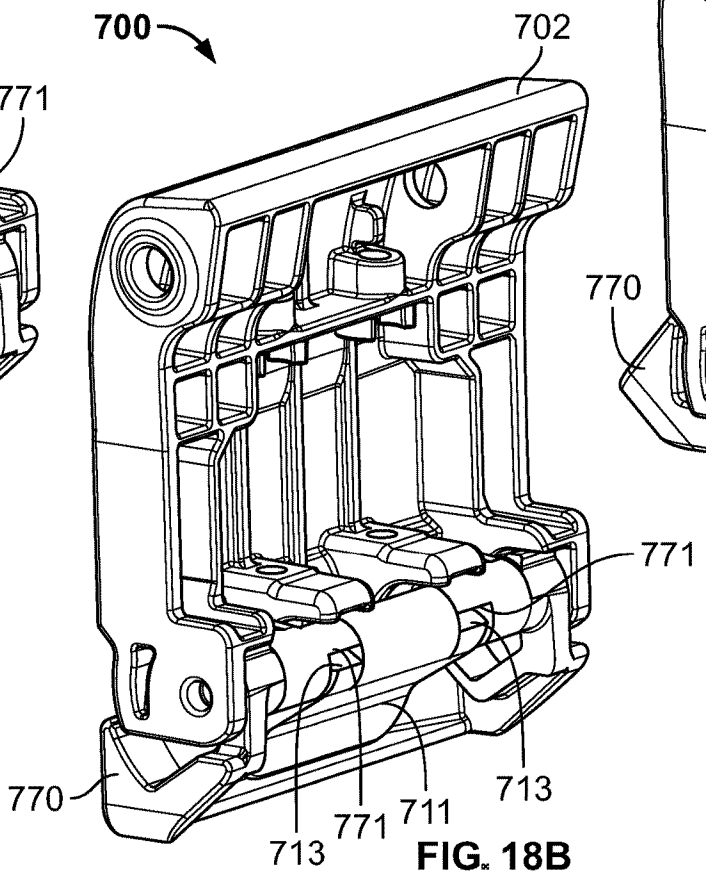
FIG. 18B illustrates a perspective view of a portion of the latch assembly of FIG. 18A in an accessible position according to one or more aspects described herein.
Figure 18A:
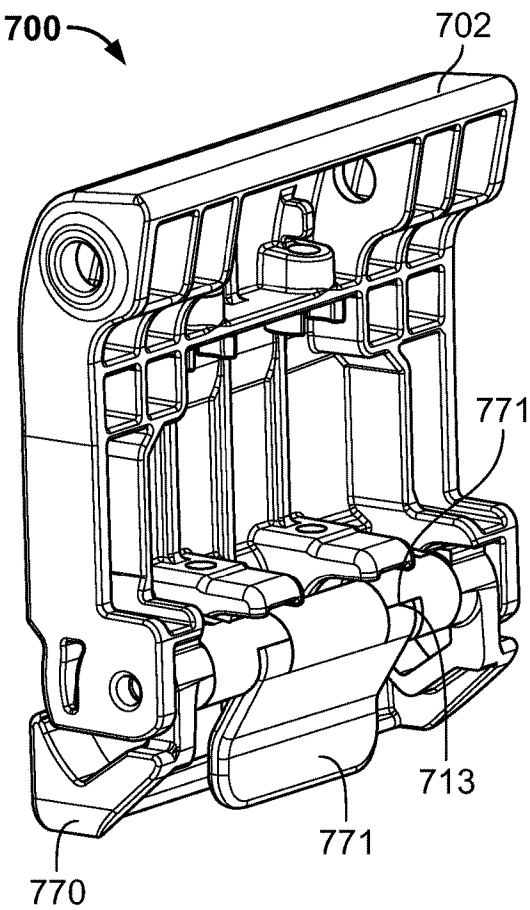
FIG. 18A illustrates a perspective view of an alternate latch assembly for the container of FIG. 1 in a restrictive position according to one or more aspects described herein.

As another alternative to a latch guard options discussed above, FIGS. 18A-18C illustrate a modified latch assembly 700. For the example latch assembly 700 of FIGS. 18A-18C, the features are referred to using similar reference numerals under the "7xx" series of reference numerals, rather than "2xx" as used in the latch assembly 200 of the container 100 of FIGS. 1-15B. Accordingly, certain features of the latch assembly 700 that were already described above with respect to latch assembly 200 of the container 100 of FIGS. 1-15B may be described in lesser detail, or may not be described at all. Latch assembly 700 may include a locking lever 711 arranged pivotally connected to the activating member 770 as well as all of the other components of latch assembly 200. FIGS. 18A-18C illustrate latch assembly 700 with some components removed to illustrate the interaction between the activating member 770 and the locking lever 711. The locking lever 711 may have a locked state that prevents the movement of the activating member 770 and an unlocked state that allows movement of the activating member 770. When the activating member 770 is able to rotate relative to the latch body 702, the latch assembly 700 is able to move to an unlocked position. FIG. 18A illustrates the locking lever 711 in a locked state where the locking lever 711 is preventing the activating member 770 from rotating, and FIG. 18B illustrates the locking lever 711 in an unlocked state where the locking lever 711 is rotated with the activating member 770. In order to move the latch assembly 700 to an unlocked position, a user must pull both the activating member 770 along with the locking lever 711 which allows the latch assembly 700 to move to an unlocked position. FIG. 18C illustrates the locking lever 711 in an unlocked state along with the activating member 770 being rotated to an unlocked position.

The locking lever 711 may include a stop surface 713 that engages a corresponding stop surface 771 on the activating member 770 when the locking lever 711 is in a locked state. The stop surface 713 of the locking lever 711 may rotate away from the stop surface 771 of the activating member 770 when the locking lever 711 is pulled by a user. As the stop surface 713 moves away from the stop surfaces 771, the activating member 770 is free to rotate relative to the latch body 702. In some examples, the stop surface 713, 771 may comprise a plurality of stop surfaces 713, 771. A biasing member (not shown) may apply a force to the locking lever 711 to bias the locking lever 711 in the locked state to keep the stop surfaces 713, 771 engaged with each other to prevent the any accidental unlocking of the latch assembly 700. This movement of the activating member 770 allows the latch assembly 700 to move to an unlocked position. Thus, to move the latch assembly 700 from a locked position to an unlocked position, a user must rotate both the locking lever 711 and the activating member 770, as shown in FIG. 18C, to move the latch assembly 700 from a locked position to an unlocked position. This dual movement helps to prevent the latch assembly 700 from being accidentally moved to an unlocked position.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A container, comprising:

a base portion including:

a sidewall structure having a first side, a second side opposite the first side, the sidewall structure having a first end and a second end;

a bottom portion connected to the first end of the sidewall structure;

an opening formed at the second end of the sidewall structure, opposite the first end, the opening being configured to allow access to an interior void of the container formed by the sidewall structure and the bottom portion;

a latch keeper extending from the sidewall structure;

a lid pivotally connected to the base portion with a hinge, the lid having an open configuration and a closed configuration, the lid configured to cover the opening formed at the second end of the sidewall structure when the container is in the closed configuration, and to allow access to the opening when the container is in the open configuration; and a latch assembly pivotally connected to the lid opposite the hinge, the latch assembly having a locked position and an unlocked position, the latch assembly comprising:

a latch body pivotally connected to the lid, the latch body comprising a pair of engagement lugs that engage the latch keeper when the latch assembly is in the locked position;

a locking member that is slidably engaged with the latch body and wherein the locking member is engaged with the latch keeper when the latch assembly is in the locked position;

and a locking button arranged on an outer surface of and movably connected to the latch body;

wherein the locking button has a locked state that prevents the latch assembly from moving to the unlocked position and an unlocked state that allows the latch assembly to move to the unlocked position; and wherein when the locking button is moved to the unlocked state, the latch assembly is able to move from the locked position to the unlocked position.

2. The container of claim 1, wherein when the locking button is in the locked state, the locking member of the latch assembly is prevented from moving relative to the latch body.

3. The container of claim 1, wherein the locking button is connected to an elongated member with an enlarged end portion that extends inward from the locking button through the latch body in a direction toward the locking member and away from the outer surface of the latch body.

4. The container of claim 3, wherein when the locking button in the locked state, the enlarged end portion is received in a recess that intersects a slot on the locking member to prevent the locking member from moving relative to the latch body.

5. The container of claim 1, wherein the lid includes a movable handle assembly comprising a handle and a plunger that includes a biasing member, wherein the handle includes a grip portion and a pair of legs, wherein each leg of the pair of legs includes a pocket that receives the plunger; and wherein the biasing member provides a longitudinal force on the plunger to prevent inadvertent movement of the handle; and wherein the handle has a stowed position and a carry position.

6. A lid for use with a container, the lid comprising:

a latch assembly pivotally connected to the lid, the latch assembly having a locked position and an unlocked position, the latch assembly comprising:

a latch body pivotally connected to the lid;

a locking member that is slidably engaged with the latch body;

an activating member pivotally connected to the latch body, wherein rotation of the activating member causes movement of the locking member relative to the latch body; and a locking button arranged on an outer surface of and connected to the latch body;

wherein the locking button has a locked state that prevents the latch assembly from moving to the unlocked position by preventing the locking member from moving relative to the latch body; and wherein the locking button is depressed and the activating member is rotated relative to the latch body to move the locking member relative to the latch body which causes the latch assembly to move from the locked position to the unlocked position.

7. The lid of claim 6, wherein the locking button is connected to a key member that is received in a slot of the locking member.

8. The lid of claim 6, wherein when the locking button is in the unlocked position, the locking member of the latch assembly is able to move relative to the latch body.

9. The lid of claim 7, wherein the key member extends inward from the locking button through the latch body in a direction toward the locking member and away from the outer surface of the latch body.

10. The lid of claim 7, wherein the key member comprises a generally elongated body member and an enlarged end portion.

11. The lid of claim 10, wherein when the locking button is in the locked state, the enlarged end portion of the key member is received in a recess that intersects the slot on the locking member to prevent the locking member from moving relative to the latch body.

12. The lid of claim 6, wherein the lid includes a movable handle assembly comprising a handle and a plunger that includes a biasing member, wherein the handle includes a grip portion and a pair of legs, wherein each leg of the pair of legs includes a pocket that receives the plunger; and wherein the biasing member provides a longitudinal force on the plunger to prevent inadvertent movement of the handle; and wherein the handle has a stowed position and a carry position.

13. A container comprising:

a base portion including:

a sidewall structure;

a bottom portion connected to a first end of the sidewall structure;

an opening formed at a second end of the sidewall structure, opposite the bottom portion, the opening being configured to allow access to an interior void of the container formed by the sidewall structure and the bottom portion;

a lid connected to the base portion, the lid configured to cover the opening when the container is in a closed configuration, and to allow access to the opening when the container is in an open configuration; and a latch assembly pivotally connected to the lid, the latch assembly having a locked position and an unlocked position, the latch assembly comprising:

a latch body pivotally connected to the lid;

an activating member pivotally connected to the latch body;

a locking member that is slidably engaged with the latch body, wherein rotation of the activating member causes movement of the locking member relative to the latch body; and a locking button connected to the latch body, wherein the locking button is connected to a key member that comprises an elongated body member and an enlarged end portion;

wherein the key member is received in a slot of the locking member; and wherein the locking button has a locked state that prevents the locking member from moving relative to the latch body; and wherein when the locking button is in the locked state, the enlarged end portion of the key member is received in a recess on the locking member that intersects the slot to prevent the locking member from moving relative to the latch body.

14. The container of claim 13, wherein the activating member is rotated relative to the latch body and the locking button is depressed to move the latch assembly from the locked position to the unlocked position.

15. The container of claim 13, wherein when the locking button is depressed, the locking member is able to move relative to the latch body.

16. The container of claim 1, wherein a biasing member applies a force to the locking button when in the locked state to prevent accidental unlocking of the latch assembly.

17. The container of claim 13, wherein when the locking button is depressed, the enlarged end portion is moved from the recess allowing the elongated body member to be slidably moved within the slot.

* * * * *